US006988018B2

(12) United States Patent
Eames

(10) Patent No.: US 6,988,018 B2
(45) Date of Patent: Jan. 17, 2006

(54) SYSTEM AND METHOD FOR ANALYZING CONTROLLING FORMING SECTIONS OF A PAPER MACHINE IN OPERATION

(76) Inventor: John D. Eames, 5240 Mill Dam Rd., Wake Forest, NC (US) 27587

( * ) Notice: Subject to any disclaimer, the term of this patent is extended or adjusted under 35 U.S.C. 154(b) by 453 days.

(21) Appl. No.: 10/261,401

(22) Filed: Oct. 1, 2002

(65) Prior Publication Data

US 2003/0120373 A1 Jun. 26, 2003

Related U.S. Application Data

(63) Continuation-in-part of application No. 10/027,527, filed on Dec. 26, 2001, now abandoned.

(51) Int. Cl.
*G06F 19/00* (2006.01)

(52) U.S. Cl. ..... 700/129; 162/351

(58) Field of Classification Search ..... 400/122, 400/127–129, 167; 162/231, 262, 263, 199, 162/272, 312, 354, 374, 115, 205, 301, 351, 162/352

See application file for complete search history.

(56) References Cited

U.S. PATENT DOCUMENTS 4,447,296 A * 5/1984 Cruse ..... 162/312
4,838,996 A * 6/1989 Kallmes ..... 162/352
5,735,330 A * 4/1998 Buchmann et al. ..... 162/301
5,951,823 A * 9/1999 Cabrera Y Lopez Caram et al. ..... 162/352
6,030,501 A * 2/2000 Neun et al. ..... 162/352
6,274,002 B1 * 8/2001 Rulis et al. ..... 162/352

OTHER PUBLICATIONS

Eames, John, "Modified Foiled Blade Design Improves Forming Board Drainage, Turbulence", Apr. 1993, Pulp & Paper Magazine,.*

Eames, John, "Modified Foil Blade Design Improves Forming Board Drainage, Turbulence", Weaveexx web page.*

* cited by examiner

*Primary Examiner*—Jayprakash N. Gandhi
*Assistant Examiner*—Chad Rapp
(74) *Attorney, Agent, or Firm*—MacCord Mason, PLLC

(57) ABSTRACT

A system and method for analyzing and controlling various parameters of a paper machine in its operation, in particular in the forming section of the paper machine, including but not limited to characteristics relating to foil blades wherein the activity and drainage characteristics associated with the blades, along with other parameters like sheet activity, sheet and fabric acceleration, sheet and fabric deflection, moisture profiles, and drainage, can be substantially separately and independently analyzed, established, and controlled, and for representing these parameters, settings, characteristics or configurations of the paper machine operation and the sheet being produced thereon in a diagrammatic manner on a computer screen and printouts or any computer readable medium.

11 Claims, 22 Drawing Sheets

Conventional Foil Blades

Figure 8 ADFA Program Startup Sheet
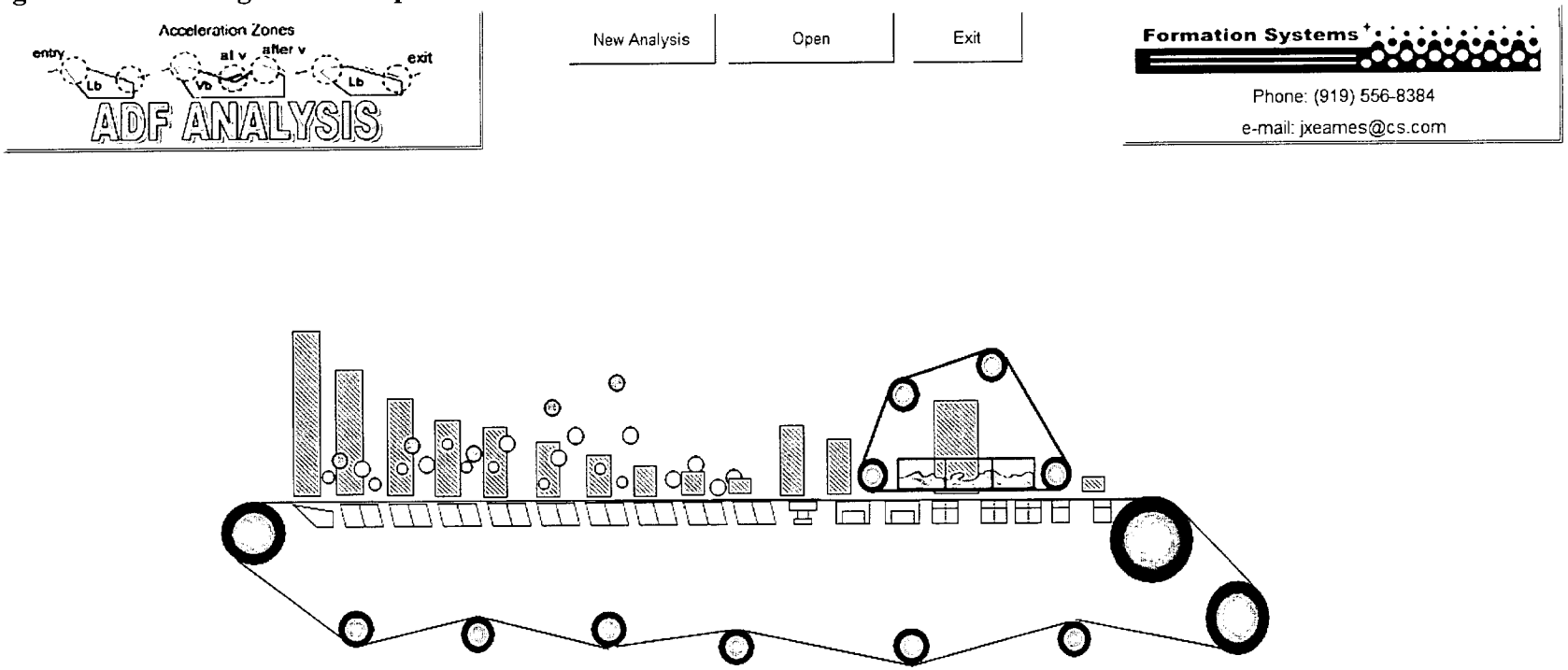

Figure 9 Zone Accelerations for Two Forming Tables and Dropdown for Editing V Blade V-Width

Customer: Any
Machine No: 1 Position: Only
Grade: Fine Wire type: Single layer

Acceleration Zones

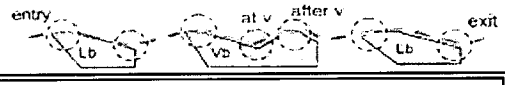

Date: 6/27/02 Time: 12:00
By: John Eames

| | Imperial | | Metric | Operating Ranges | | |
|---|---|---|---|---|---|---|
| Basis weight: | 33.0 | Lbs / 1000 | 162 g/m² | 23 | to | 33 |
| Basis wgt (RS): | 33.0 | Lbs / 1000 | 162 g/m² | 23 | to | 33.0 |
| Wire speed: | 1500 | fpm | 457 m/min | 900 | to | 1500 |
| Hd box Cons: | 1.10 | % | | 0.8 | to | 1 |

Table I Comments: Table I shows a table configuration with conventional linear foil blades at various drainage angles
Table II Comments: Table II shows a table configuration with V type foil blades at various V entry angles and various drainage angles
General Comments:

Foil Blade Table

| Alias names: | cer1 | poly1 | H5.25 | cer2 | poly2 | jde1 | x |
|---|---|---|---|---|---|---|---|
| Foil Blade Type: | Lb1 | Lb2 | Vb0 | Vb1 | Vb2 | Vb3 | x |
| Total blade width: | 2.5 | 2.5 | 4.62 | 4.62 | 4.50 | 4.50 | 0 |
| Turbo Nip width: | 0.0 | 0.0 | 0.50 | 0.50 | 0.50 | 0.50 | 0 |
| Flat width: | 0.38 | 0.38 | 0.38 | 0.38 | 0.38 | 0.38 | 0 |
| "V" entry angle width: | 0.0 | 0.0 | 2.00 | 2.00 | 2.00 | 2.00 | 0 |
| Total "V" width: | 0.0 | 0.0 | | 2.25 | 2.25 | 2.25 | 0 |
| Drainage Nip width: | 2.12 | 2.24 | | 1.11 | 1.00 | 1.00 | 0 |
| Fabric V S factor: | 0.0 | 0.0 | | 0.56 | 0.80 | 0.80 | 0 |

1
1.5
2
2.5
3
3.5

Zoom Area: *Full Table*

TABLE I - ZONE ACCELERATIONS Vs TABLE LOCATION

Table Min: 58 Table Max: 242 in

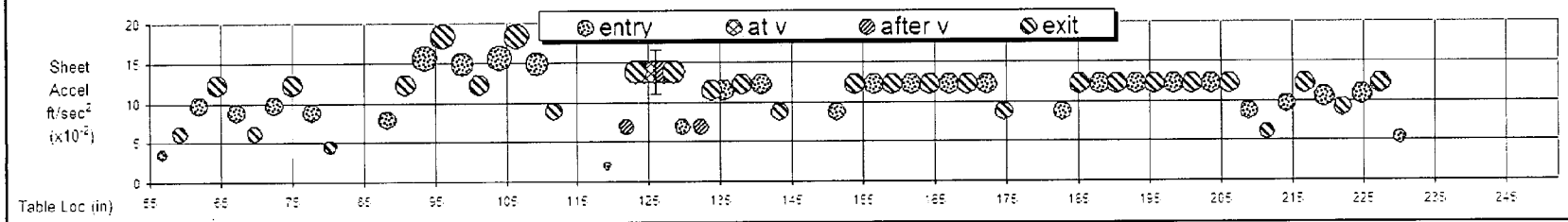

| Tee - Bar No.: | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 | 31 | 32 |
|---|---|---|---|---|---|---|---|---|---|---|---|---|---|---|---|---|---|---|---|---|---|---|---|---|---|---|---|---|---|---|---|---|
| Dist. to Prev box: | 10.5 | 5.25 | 5.25 | 5.25 | 5.25 | 10.50 | 5.25 | 5.25 | 5.25 | 5.25 | 10.50 | 5.25 | 5.25 | 5.25 | 5.25 | 10.50 | 5.25 | 5.25 | 5.25 | 5.25 | 10.50 | 5.25 | 5.25 | 5.25 | 5.25 | 5.25 | 5.25 | 5.25 | 5.25 | 5.25 | 5.25 | 5.25 |
| Blade Type: | Lb1 | Lb1 | Lb1 | Lb1 | Lb1 | Lb1 | Lb1 | Lb1 | Lb1 | Lb1 | Vb0 | Vb0 | Vb0 | Lb1 | Lb1 | Lb1 | Lb1 | Lb1 | Lb1 | Lb1 | Lb1 | Lb1 | Lb1 | Lb1 | Lb1 | Lb1 | Lb1 | Lb1 | Lb1 | Lb1 | Lb1 | Lb1 |
| V entry Angle (β): | 0.0 | 0.0 | 0.0 | 0.0 | 0.0 | 0.0 | 0.0 | 0.0 | 0.0 | 0.0 | 0.0 | 2.0 | 0.0 | 0.0 | 0.0 | 0.0 | 0.0 | 0.0 | 0.0 | 0.0 | 0.0 | 0.0 | 0.0 | 0.0 | 0.0 | 0.0 | 0.0 | 0.0 | 0.0 | 0.0 | 0.0 | 0.0 |
| Drn Angle (α): | 1.0 | 2.0 | 1.0 | 2.0 | 1.0 | 2.0 | 3.0 | 2.0 | 3.0 | 2.0 | 2.0 | 2.0 | 2.0 | 2.0 | 2.0 | 2.0 | 2.0 | 2.0 | 2.0 | 2.0 | 2.0 | 2.0 | 2.0 | 2.0 | 2.0 | 1.0 | 2.0 | 1.5 | 2.0 | 0.0 | 0.0 | 0.0 |

Zoom Area: *Full Table*

TABLE II - ZONE ACCELERATIONS Vs TABLE LOCATION

Table Min: 58 in Table Max: 242 in

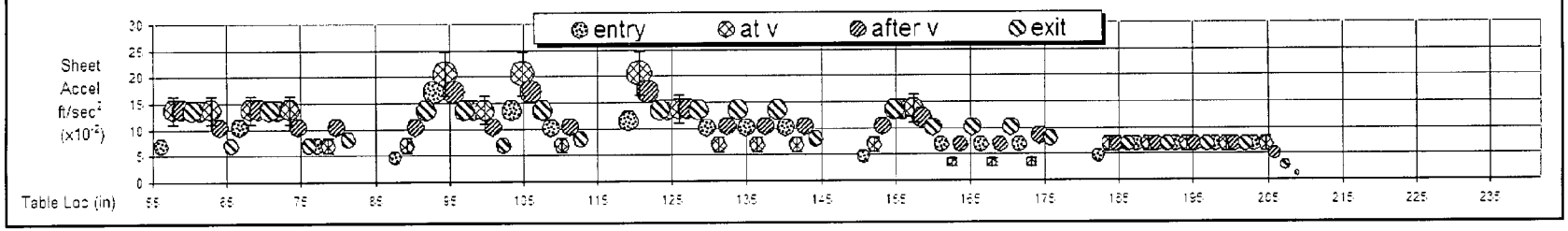

Figure 10 Zone Acceleration of Two Forming Tables with Dropdown for Selecting V-Angle

Customer: Any
Machine No: 1 Position: Only
Grade: Fine Wire type: Single layer

Acceleration Zones

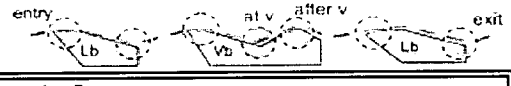

Date: 6/27/02 Time: 12:00
By: John Eames

| | Imperial | | Metric | Operating Ranges | | |
|---|---|---|---|---|---|---|
| Basis weight: | 33.0 | Lbs / 1000 | 162 g/m² | 23 | to | 33 |
| Basis wgt (RS): | 33.0 | Lbs / 1000 | 162 g/m² | 23 | to | 33.0 |
| Wire speed: | 1500 | fpm | 457 m/min | 900 | to | 1500 |
| Hd box Cons: | 1.10 | % | | 0.8 | to | 1 |

Table I Comments: Table I shows a table configuration with conventional linear foil blades at various drainage angles
Table II Comments: Table II shows a table configuration with V type foil blades at various V entry angles and various drainage angles
General Comments:

Foil Blade Table

| Alias names: | cer1 | poly1 | H5.25 | cer2 | poly2 | jde1 | x |
|---|---|---|---|---|---|---|---|
| Foil Blade Type: | Lb1 | Lb2 | Vb0 | Vb1 | Vb2 | Vb3 | x |
| Total blade width: | 2.5 | 2.6 | 4.62 | 4.62 | 4.50 | 4.50 | 0 |
| Turbo Nip width: | 0.0 | 0.0 | 0.50 | 0.50 | 0.50 | 0.50 | 0 |
| Flat width: | 0.38 | 0.38 | 0.38 | 0.38 | 0.38 | 0.38 | 0 |
| "V" entry angle width: | 0.0 | 0.0 | 2.00 | 2.00 | 2.00 | 2.00 | 0 |
| Total "V" width: | 0.0 | 0.0 | 2.25 | 2.25 | 2.25 | 2.25 | 0 |
| Drainage Nip width: | 2.12 | 2.24 | 1.12 | 1.11 | 1.00 | 1.00 | 0 |
| Fabric V δ factor: | 0.0 | 0.0 | 0.56 | 0.56 | 0.80 | 0.80 | 0 |

Zoom Area: *Full Table*

TABLE I - ZONE ACCELERATIONS Vs TABLE LOCATION

Table Min: 58 in Table Max: 242 in

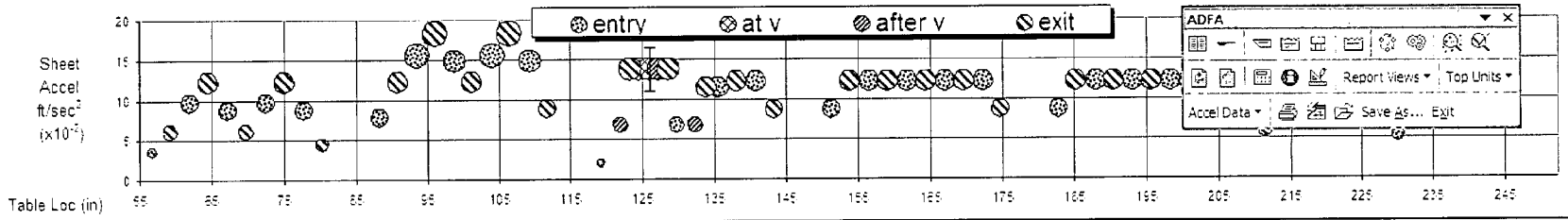

| Tee - Bar No.: | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 | 31 | 32 |
|---|---|---|---|---|---|---|---|---|---|---|---|---|---|---|---|---|---|---|---|---|---|---|---|---|---|---|---|---|---|---|---|---|
| Dist. to Prev box: | 10.5 | 5.25 | 5.25 | 5.25 | 5.25 | 10.50 | 5.25 | 5.25 | 5.25 | 5.25 | 10.50 | 5.25 | 5.25 | 5.25 | 5.25 | 10.50 | 5.25 | 5.25 | 5.25 | 5.25 | 10.50 | 5.25 | 5.25 | 5.25 | 5.25 | 5.25 | 5.25 | 5.25 | 5.25 | 5.25 | 5.25 | 5.25 |
| Blade Type: | Lb1 | Lb1 | Lb1 | Lb1 | Lb1 | Lb1 | Lb1 | Lb1 | Lb1 | Lb1 | Vb0 | Vb0 | Vb0 | Lb1 | Lb1 | Lb1 | Lb1 | Lb1 | Lb1 | Lb1 | Lb1 | Lb1 | Lb1 | Lb1 | Lb1 | Lb1 | Lb1 | Lb1 | Lb1 | Lb1 | Lb1 | Lb1 |
| V entry Angle (β): | 0.0 | 0.0 | 0.0 | 0.0 | 0.0 | 0.0 | 0.0 | 0.0 | 0.0 | 0.0 | 0.0 | 2.0 | 2.0 | 0.0 | 0.0 | 0.0 | 0.0 | 0.0 | 0.0 | 0.0 | 0.0 | 0.0 | 0.0 | 0.0 | 0.0 | 0.0 | 0.0 | 0.0 | 0.0 | 0.0 | 0.0 | 0.0 |
| Drn Angle (α): | 1.0 | 2.0 | 1.0 | 2.0 | 1.0 | 2.0 | 3.0 | 2.0 | 3.0 | 2.0 | 2.0 | 0 | 2.0 | 2.0 | 2.0 | 2.0 | 2.0 | 2.0 | 2.0 | 2.0 | 2.0 | 2.0 | 2.0 | 2.0 | 2.0 | 1.0 | 2.0 | 1.5 | 2.0 | 0.0 | 0.0 | 0.0 |

0
.5
1
1.5
2
2.5
3
4

Zoom Area: *Full Table*

TABLE II ACCELERATIONS Vs TABLE LOCATION

Table Min: 58 in Table Max: 242 in

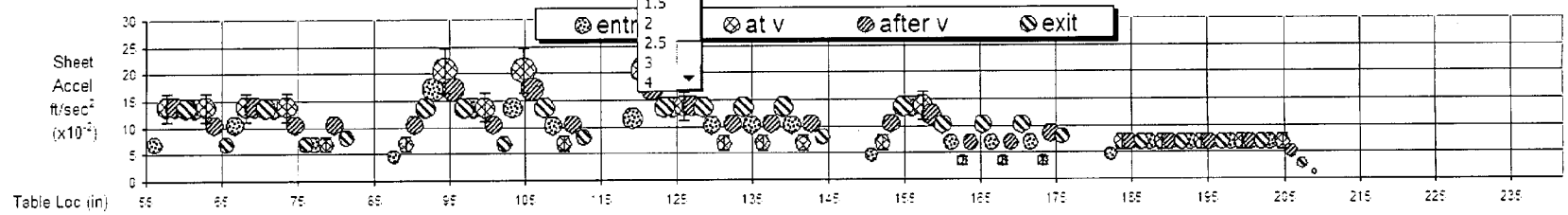

Figure 11 Zones Accelerations and Fabric Deflected Path for One Forming Table

Customer: Any
Machine No: 1 Position: Only
Grace: Fine Wire type: Single layer

Acceleration Zones

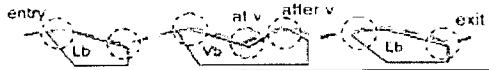

Date: 6/27/02 Time: 12:00
By: John Eames

| | Imperial | | Metric | Operating Ranges | | |
|---|---|---|---|---|---|---|
| Basis weight: | 33.0 | Lbs / 1000 | 162 g/m² | 23 | to | 33 |
| Basis wgt (RS): | 33.0 | Lbs / 1000 | 162 g/m² | 23 | to | 33.0 |
| Wire speed: | 1500 | fpm | 457 m/min | 900 | to | 1500 |
| Hd box Cons: | 1.10 | % | | 0.8 | to | 1 |

ADFA
Report Views Top Units
Accel Date Save As... Exit

Table I Comments: Table I shows a table configuration with conventional linear foil blades at v
Table II Comments: Table II shows a table configuration with V type foil blades at various V entry angles and various drainage angles
General Comments:

Foil Blade Table

| Alias names: | cer1 | poly1 | H5.25 | cer2 | poly2 | jde1 | x |
|---|---|---|---|---|---|---|---|
| Foil Blade Type: | Lb1 | Lb2 | Vb0 | Vb1 | Vb2 | Vb3 | x |
| Total blade width: | 2.5 | 2.5 | 4.62 | 4.62 | 4.50 | 4.50 | 0 |
| Turbo Nip width: | 0.0 | 0.0 | 0.50 | 0.50 | 0.50 | 0.50 | 0 |
| Flat width: | 0.38 | 0.38 | 0.38 | 0.38 | 0.38 | 0.38 | 0 |
| "V" entry angle width: | 0.0 | 0.0 | 2.00 | 2.00 | 2.00 | 2.00 | 0 |
| Total "V" width: | 0.0 | 0.0 | 2.25 | 2.25 | 2.25 | 2.25 | 0 |
| Drainage Nip width: | 2.12 | 2.24 | 1.12 | 1.11 | 1.00 | 1.00 | 0 |
| Fabric V δ factor: | 0.0 | 0.0 | 0.56 | 0.56 | 0.80 | 0.80 | 0 |

Zoom Area: *Full Table*

TABLE I - ZONE ACCELERATIONS Vs TABLE LOCATION

Table Min: 58 in Table Max: 242 in

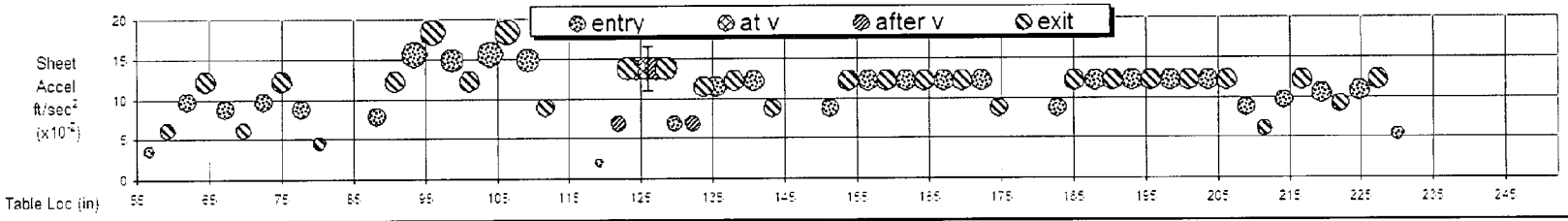

| Tee - Bar No.: | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 | 31 | 32 |
|---|---|---|---|---|---|---|---|---|---|---|---|---|---|---|---|---|---|---|---|---|---|---|---|---|---|---|---|---|---|---|---|---|
| Dist. to Prev box: | 10.5 | 5.25 | 5.25 | 5.25 | 5.25 | 10.50 | 5.25 | 5.25 | 5.25 | 5.25 | 10.50 | 5.25 | 5.25 | 5.25 | 5.25 | 10.50 | 5.25 | 5.25 | 5.25 | 5.25 | 10.50 | 5.25 | 5.25 | 5.25 | 5.25 | 5.25 | 5.25 | 5.25 | 5.25 | 5.25 | 5.25 | 5.25 |
| Blade Type: | Lb1 | Lb1 | Lb1 | Lb1 | Lb1 | Lb1 | Lb1 | Lb1 | Lb1 | Lb1 | Vb0 | Vb0 | Vb0 | Lb1 | Lb1 | Lb1 | Lb1 | Lb1 | Lb1 | Lb1 | Lb1 | Lb1 | Lb1 | Lb1 | Lb1 | Lb1 | Lb1 | Lb1 | Lb1 | Lb1 | Lb1 | Lb1 |
| V entry Angle (β1): | 0.0 | 0.0 | 0.0 | 0.0 | 0.0 | 0.0 | 0.0 | 0.0 | 0.0 | 0.0 | 0.0 | 2.0 | 0.0 | 0.0 | 0.0 | 0.0 | 0.0 | 0.0 | 0.0 | 0.0 | 0.0 | 0.0 | 0.0 | 0.0 | 0.0 | 0.0 | 0.0 | 0.0 | 0.0 | 0.0 | 0.0 | 0.0 |
| Drn Angle (α1): | 1.0 | 2.0 | 1.0 | 2.0 | 1.0 | 2.0 | 3.0 | 2.0 | 3.0 | 2.0 | 2.0 | 2.0 | 2.0 | 2.0 | 2.0 | 2.0 | 2.0 | 2.0 | 2.0 | 2.0 | 2.0 | 2.0 | 2.0 | 2.0 | 2.0 | 1.0 | 2.0 | 1.5 | 2.0 | 0.0 | 0.0 | 0.0 |

Zoom Area: *Full Table*

Table I Harmonics - Fabric Deflection Path

Table Min: 55 in Table Max: 242 in

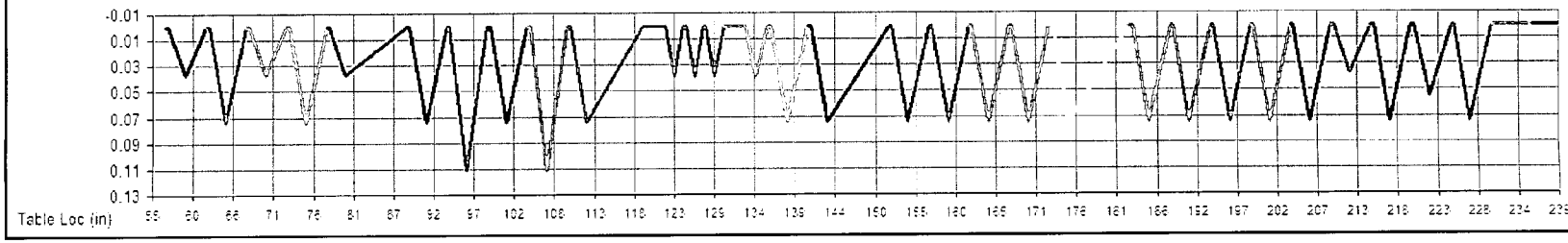

Figure 12 Drainage Model Sheet and Dialog Box for Entering Forming Board Data
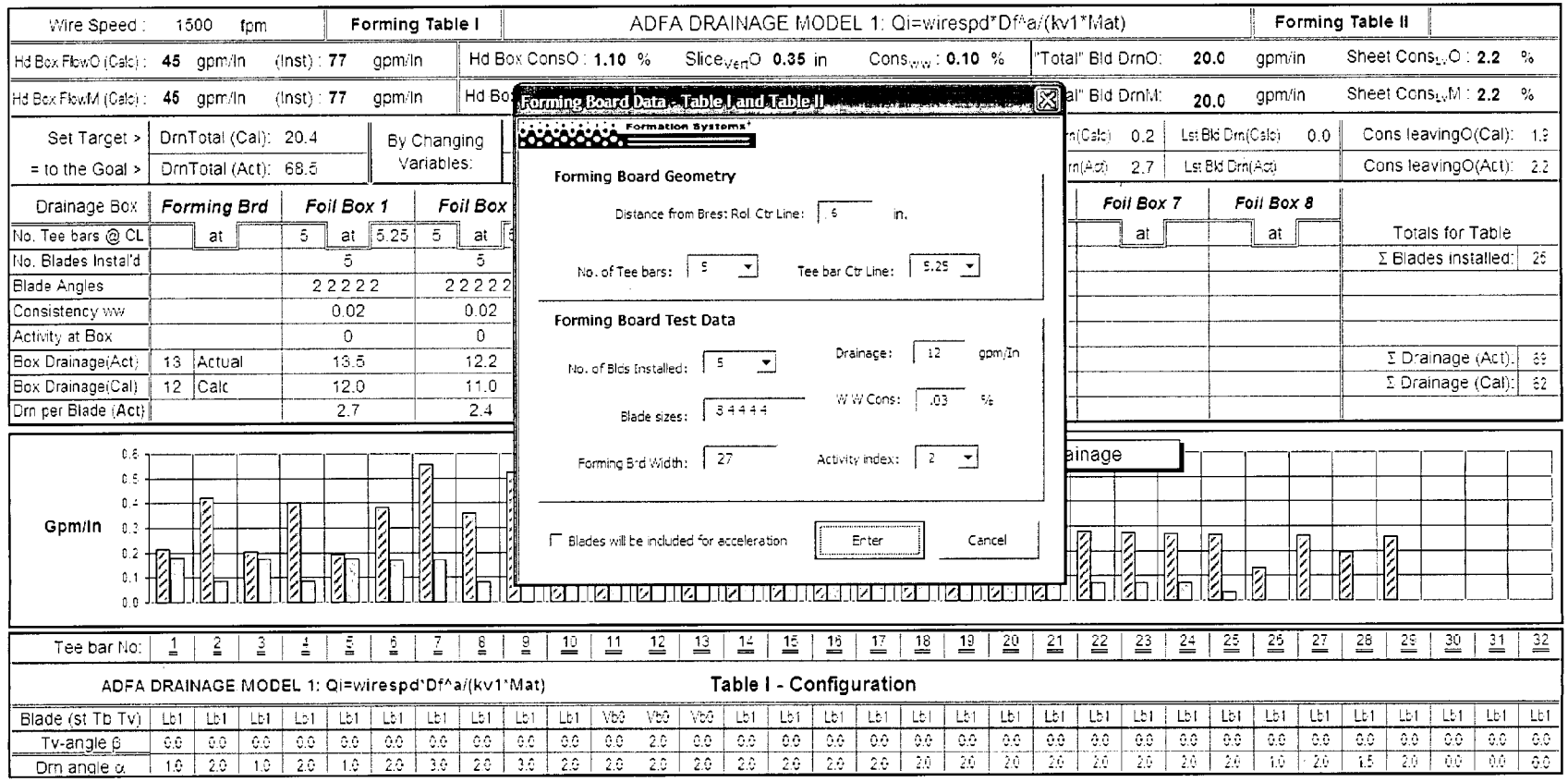

Figure 13 Drainage Model Sheet and Dialog Box for Designing V-Type Foil Blades
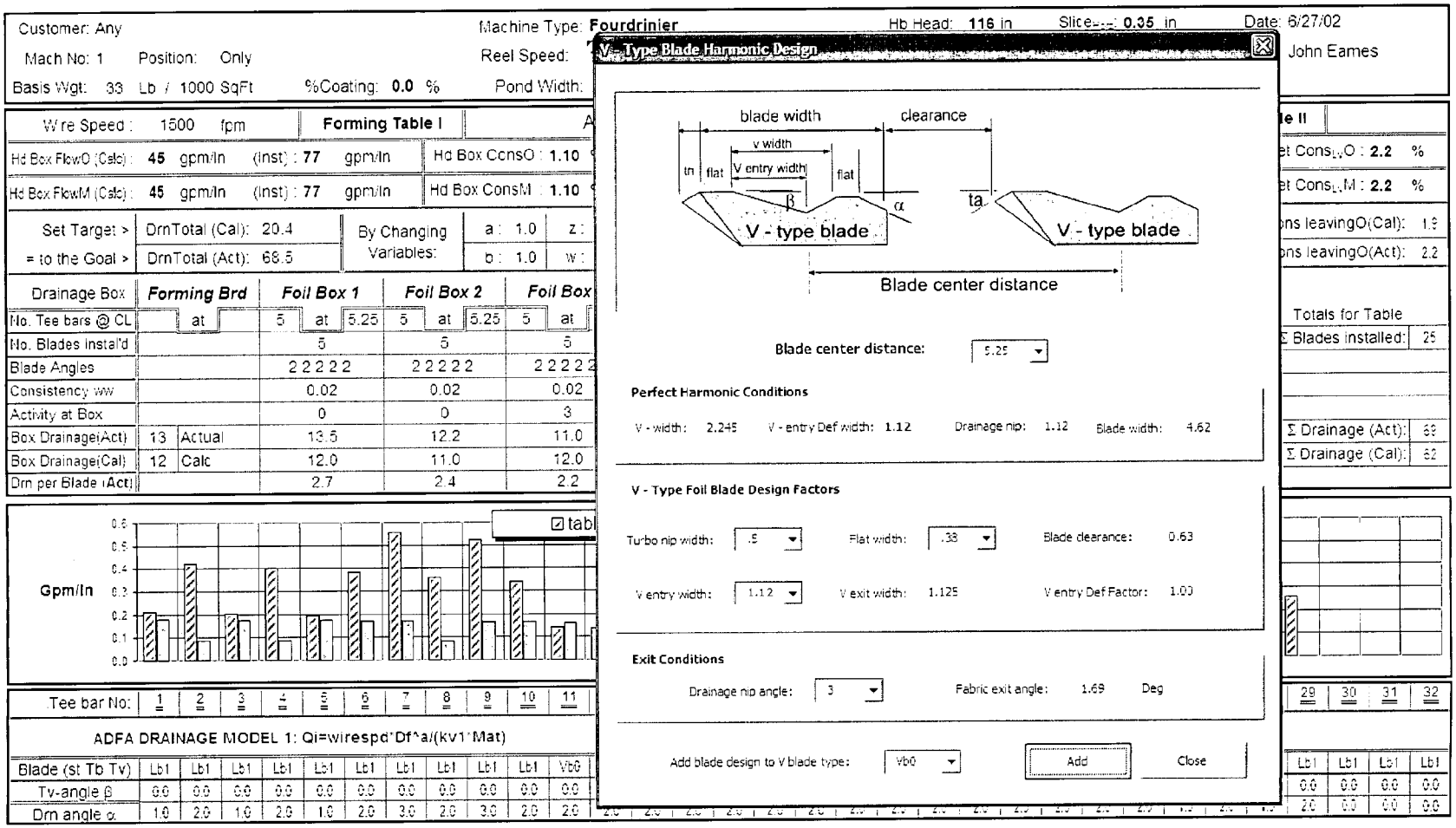

Figure 14 Two Forming Table Configurations and Dialog Box for Entering Foil Blade Data

| | Imperial | | Metric | Operating Ranges |
|---|---|---|---|---|
| Basis weight: | 33.0 | Lbs / 1000 | | |
| Basis wgt (RS): | 33.0 | Lbs / 1000 | | |
| Wire speed: | 1500 | fpm | | |
| Hd box Cons: | 1.10 | % | | |

ADFA — Report Views — Top Units — Accel Data — Save As... Exit

Table I Comments: Table I shows a table configuration with conventional linear foil blades at various drainage angles Table I Comments: Table II shows a table configuration with V type foil blades at various V entry angles and various drain General Comments:

Zoom Area: *Full Table* — TABLE I - ZONE ACCELERATIONS V

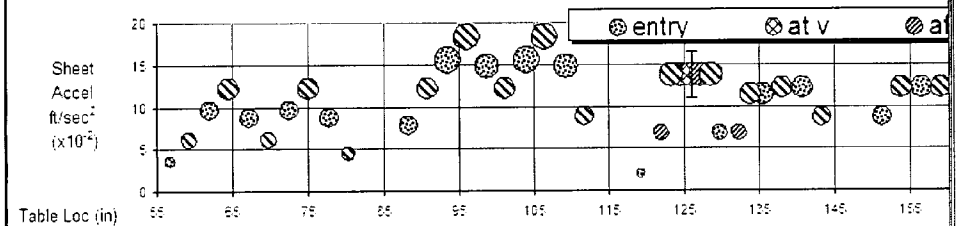

| Tee - Bar No.: | 1 | 2 | 3 | 4 | 5 | 6 | 7 | 8 | 9 | 10 | 11 | 12 | 13 | 14 | 15 | 16 | 17 |
|---|---|---|---|---|---|---|---|---|---|---|---|---|---|---|---|---|---|
| Dist. to Prev box: | 10.5 | 5.25 | 5.25 | 5.25 | 5.25 | 10.50 | 5.25 | 5.25 | 5.25 | 5.25 | 10.50 | 5.25 | 5.25 | 5.25 | 5.25 | 10.50 | 5.25 |
| Blade Type: | Lb1 | Lb1 | Lb1 | Lb1 | Lb1 | Lb1 | Lb1 | Lb1 | Lb1 | Lb1 | Vb0 | Vb0 | Vb0 | Lb1 | Lb1 | Lb1 | Lb1 |
| V entry Angle (β): | 0.0 | 0.0 | 0.0 | 0.0 | 0.0 | 0.0 | 0.0 | 0.0 | 0.0 | 0.0 | 0.0 | 2.0 | 0.0 | 0.0 | 0.0 | 0.0 | 0.0 |
| Drn Angle (α): | 1.0 | 2.0 | 1.0 | 2.0 | 1.0 | 2.0 | 3.0 | 2.0 | 3.0 | 2.0 | 2.0 | 2.0 | 2.0 | 2.0 | 2.0 | 2.0 | 2.0 |

Zoom Area: *Full Table* — TABLE II - ZONE ACCELERATIONS V

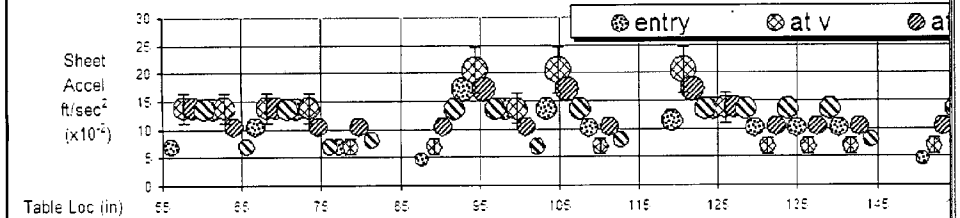

| Tee - Bar No.: | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 | 31 | 32 |
|---|---|---|---|---|---|---|---|---|---|---|---|---|---|---|---|---|---|---|---|---|---|---|---|---|---|---|---|---|---|---|---|---|
| Dist. to Prev box: | 10.50 | 5.25 | 5.25 | 5.25 | 5.25 | 10.50 | 5.25 | 5.25 | 5.25 | 5.25 | 10.50 | 5.25 | 5.25 | 5.25 | 5.25 | 10.50 | 5.25 | 5.25 | 5.25 | 5.25 | 10.50 | 5.25 | 5.25 | 5.25 | 5.25 | 5.25 | 5.25 | 5.25 | 5.25 | 5.25 | 5.25 | 5.25 |
| Blade Type: | Vb0 | Vb0 | Vb0 | Vb0 | Vb0 | Vb0 | Vb0 | Vb1 | Vb0 | Vb0 | Vb0 | Vb0 | Vb0 | Vb0 | Vb0 | Vb0 | Vb0 | Vb0 | Vb0 | Vb0 | Vb1 | Vb1 | Vb1 | Vb1 | Vb1 | Lb1 | Lb1 | Lb1 | Lb1 | Lb1 | Lb1 | Lb1 |
| V entry Angle (β): | 2.0 | 2.0 | 2.0 | 2.0 | 1.0 | 1.0 | 3.0 | 2.0 | 3.0 | 1.0 | 3.0 | 2.0 | 1.0 | 1.0 | 1.0 | 1.0 | 2.0 | 0.5 | 0.5 | 0.5 | 1.0 | 1.0 | 1.0 | 1.0 | 1.0 | 0.0 | 0.0 | 0.0 | 0.0 | 0.0 | 0.0 | 0.0 |
| Drn Angle (α): | 2.0 | 1.0 | 2.0 | 1.0 | 2.0 | 2.0 | 2.0 | 1.0 | 2.0 | 2.0 | 2.0 | 2.0 | 2.0 | 2.0 | 2.0 | 2.0 | 1.5 | 1.5 | 1.5 | 2.0 | 1.0 | 1.0 | 1.0 | 1.0 | 0.5 | 0.0 | 0.0 | 0.0 | 0.0 | 0.0 | 0.0 | 0.0 |

Foil Box Data - Table I and Table II

Formation Systems

Progress

Foil Box No: 1 — Total Tee bars/blades entered: 0

Distance Between Boxes

Distance between the last Tee of Previous box to first Tee this box: 10.5

Test Data

Box drainage: 0.0 gpm/in

WW Cons: 0.02 %

Activity Index: 0

Foil Box Data

Number of Tee bars on box: 5

Tee bar spacing on box: 5.25

Foil Blade Data

*Note: If Tee bar is vacant select "x" for foil blade type*

Foil Blade Types - Linear blade (Lb), V type blade (Vb)

Lb1 Lb1 Lb1 Lb1 Lb1

V type blade - V Angle 0 0 0 0 0

Drainage angle 2 2 2 2 2

Check if last box ( less than 32 Tee bars): ☐ Enter Data Cancel

Figure 15 Two Forming Tables with One Table Zoomed and Dialog Box for Designing Harmonic V-Type Foil Blades
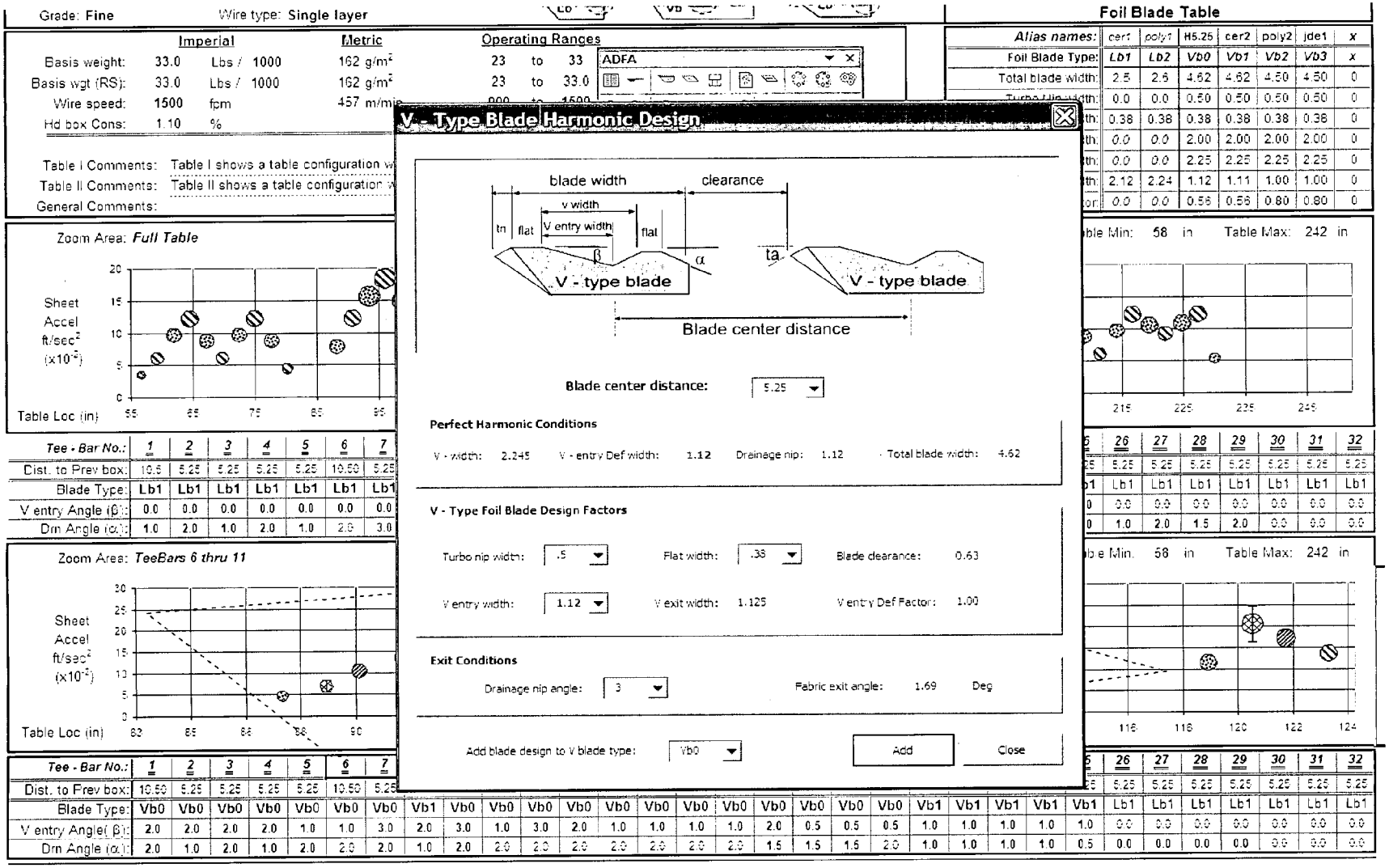

Figure 16 Two Forming Tables and Dialog Box for Zooming Specific Tee Bar Locations

| | Imperial | | Metric | Operating Ranges | | |
|---|---|---|---|---|---|---|
| Basis weight: | 33.0 | Lbs / 1000 | 162 g/m² | 23 | to | 33 |
| Basis wgt (RS): | 33.0 | Lbs / 1000 | 162 g/m² | 23 | to | 33.0 |
| Wire speed: | 1500 | fpm | 457 m/min | 900 | to | 1500 |
| Hd box Cons: | 1.10 | % | | 0.8 | to | 1 |

Table I Comments: Table I shows a table configuration with conventional linear foil blades at various drainage angles Table II Comments: Table II shows a table configuration with V type foil blades at various V entry angles and various drainage angles General Comments:

| Alias names: | cer1 | poly1 | H5.25 | cer2 | poly2 | jde1 | x |
|---|---|---|---|---|---|---|---|
| Foil Blade Type: | Lb1 | Lb2 | Vb0 | Vb1 | Vb2 | Vb3 | x |
| Total blade width: | 2.5 | 2.6 | 4.62 | 4.62 | 4.50 | 4.50 | 0 |
| Turbo Nip width: | 0.0 | 0.0 | 0.50 | 0.50 | 0.50 | 0.50 | 0 |
| Flat width: | 0.38 | 0.38 | 0.38 | 0.38 | 0.38 | 0.38 | 0 |
| "V" entry angle width: | 0.0 | 0.0 | 2.00 | 2.00 | 2.00 | 2.00 | 0 |
| Total "V" width: | 0.0 | 0.0 | 2.25 | 2.25 | 2.25 | 2.25 | 0 |
| Drainage Nip width: | 2.12 | 2.24 | 1.12 | 1.11 | 1.00 | 1.00 | 0 |
| Fabric V δ factor: | 0.0 | 0.0 | 0.56 | 0.55 | 0.80 | 0.80 | 0 |

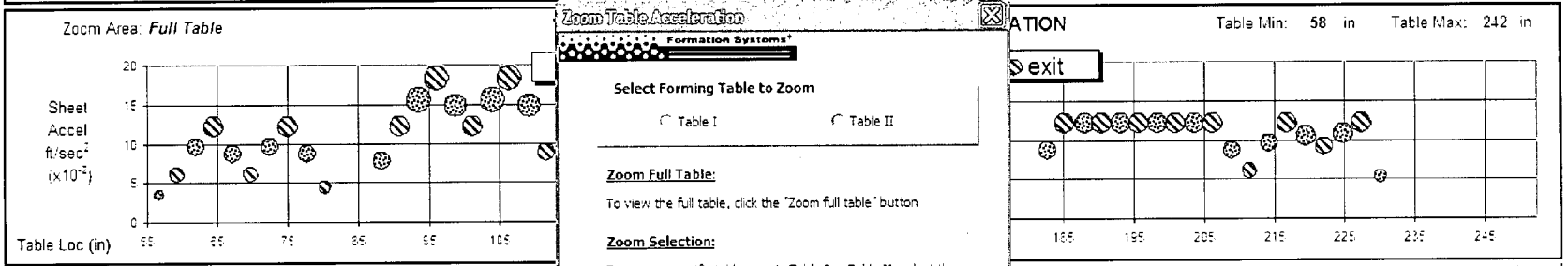

| Tee - Bar No.: | 1 | 2 | 3 | 4 | 5 | 6 | 7 | 8 | 9 | 21 | 22 | 23 | 24 | 25 | 26 | 27 | 28 | 29 | 30 | 31 | 32 |
|---|---|---|---|---|---|---|---|---|---|---|---|---|---|---|---|---|---|---|---|---|---|
| Dist. to Prev box: | 10.5 | 5.25 | 5.25 | 5.25 | 5.25 | 10.50 | 5.25 | 5.25 | 5.25 | 10.50 | 5.25 | 5.25 | 5.25 | 5.25 | 5.25 | 5.25 | 5.25 | 5.25 | 5.25 | 5.25 | 5.25 |
| Blade Type: | Lb1 | Lb1 | Lb1 | Lb1 | Lb1 | Lb1 | Lb1 | Lb1 | Lb1 | Lb1 | Lb1 | Lb1 | Lb1 | Lb1 | Lb1 | Lb1 | Lb1 | Lb1 | Lb1 | Lb1 | Lb1 |
| V entry Angle (β): | 0.0 | 0.0 | 0.0 | 0.0 | 0.0 | 0.0 | 0.0 | 0.0 | 0.0 | 0.0 | 0.0 | 0.0 | 0.0 | 0.0 | 0.0 | 0.0 | 0.0 | 0.0 | 0.0 | 0.0 | 0.0 |
| Drn Angle (α): | 1.0 | 2.0 | 1.0 | 2.0 | 1.0 | 2.0 | 3.0 | 2.0 | 3.0 | 2.0 | 2.0 | 2.0 | 2.0 | 2.0 | 1.0 | 2.0 | 1.5 | 2.0 | 0.0 | 0.0 | 0.0 |

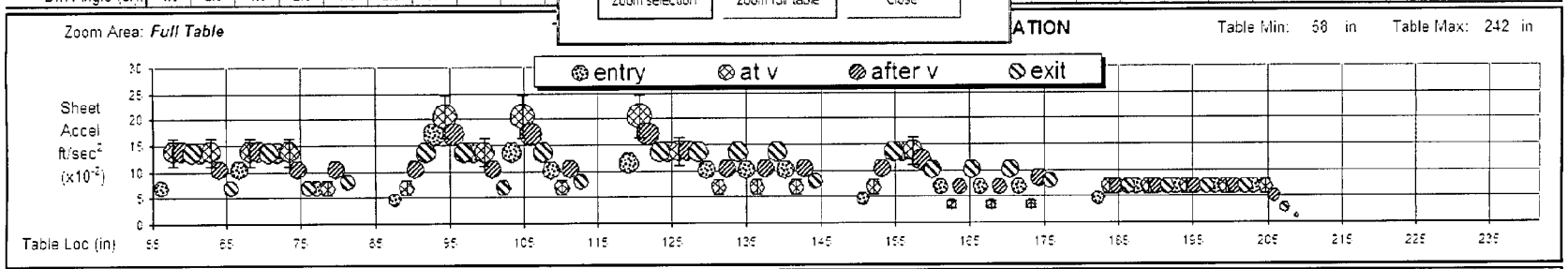

| Tee - Bar No.: | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 | 31 | 32 |
|---|---|---|---|---|---|---|---|---|---|---|---|---|---|---|---|---|---|---|---|---|---|---|---|---|---|---|---|---|---|---|---|---|
| Dist. to Prev box: | 10.50 | 5.25 | 5.25 | 5.25 | 5.25 | 10.50 | 5.25 | 5.25 | 5.25 | 5.25 | 10.50 | 5.25 | 5.25 | 5.25 | 5.25 | 10.50 | 5.25 | 5.25 | 5.25 | 5.25 | 10.50 | 5.25 | 5.25 | 5.25 | 5.25 | 5.25 | 5.25 | 5.25 | 5.25 | 5.25 | 5.25 | 5.25 |
| Blade Type: | Vb0 | Vb0 | Vb0 | Vb0 | Vb0 | Vb0 | Vb0 | Vb1 | Vb0 | Vb0 | Vb0 | Vb0 | Vb0 | Vb0 | Vb0 | Vb0 | Vb0 | Vb0 | Vb0 | Vb0 | Vb1 | Vb1 | Vb1 | Vb1 | Vb1 | Lb1 | Lb1 | Lb1 | Lb1 | Lb1 | Lb1 | Lb1 |
| V entry Angle (β): | 2.0 | 2.0 | 2.0 | 2.0 | 1.0 | 1.0 | 3.0 | 2.0 | 3.0 | 1.0 | 3.0 | 2.0 | 1.0 | 1.0 | 1.0 | 1.0 | 2.0 | 0.5 | 0.5 | 0.5 | 1.0 | 1.0 | 1.0 | 1.0 | 1.0 | 0.0 | 0.0 | 0.0 | 0.0 | 0.0 | 0.0 | 0.0 |
| Drn Angle (α): | 2.0 | 1.0 | 2.0 | 1.0 | 2.0 | 2.0 | 2.0 | 1.0 | 2.0 | 2.0 | 2.0 | 2.0 | 2.0 | 2.0 | 2.0 | 2.0 | 1.5 | 1.5 | 1.5 | 2.0 | 1.0 | 1.0 | 1.0 | 1.0 | 0.5 | 0.0 | 0.0 | 0.0 | 0.0 | 0.0 | 0.0 | 0.0 |

Figure 17 Deflected Fabric Path for Two Forming Table Configurations and Dialog Box for Zooming Specific Tee Bar Locations
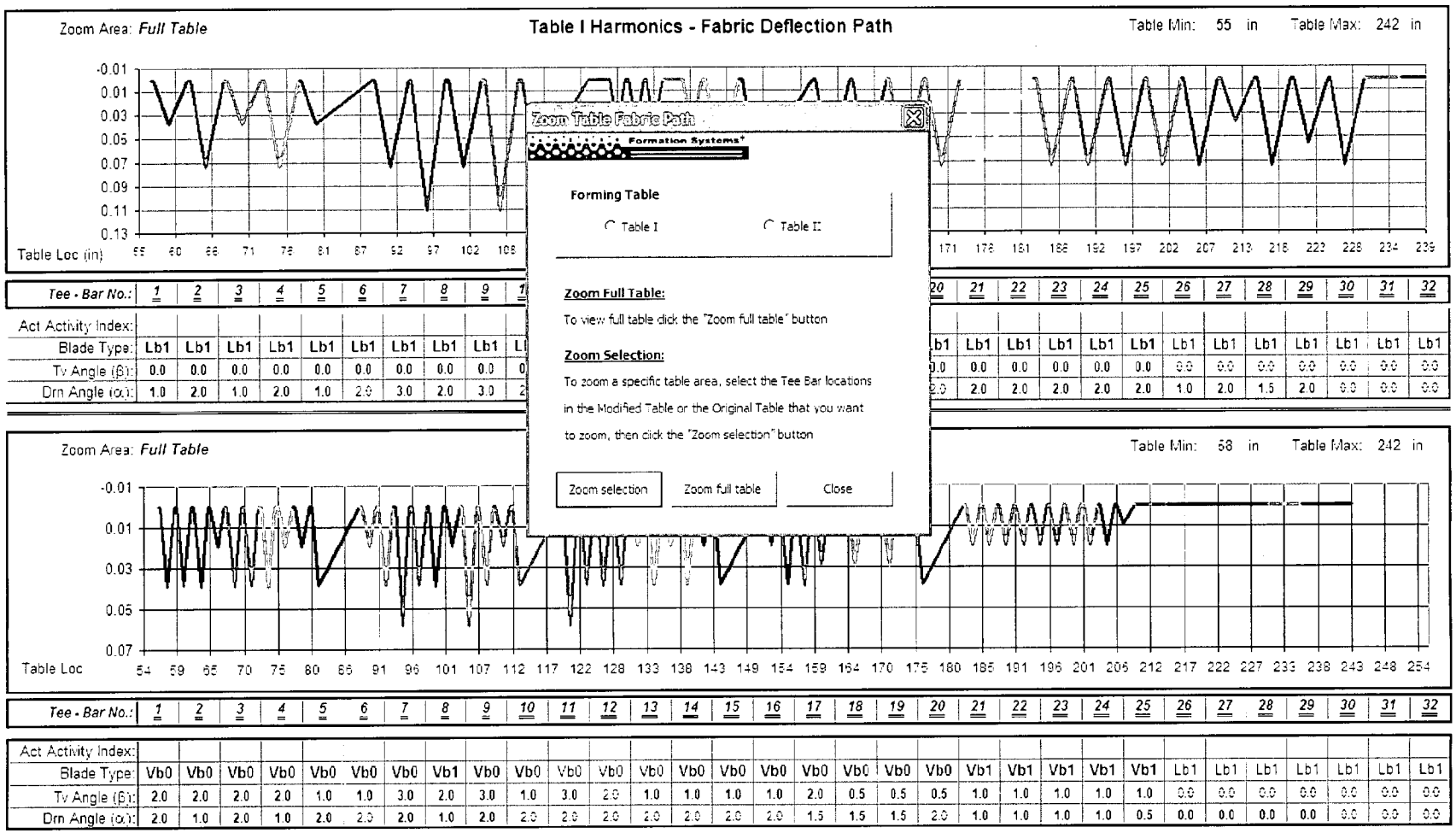

Figure 18 Table II Zone Accelerations and Stock Jump Profile with Dialog Box for Adding a Top Table Element
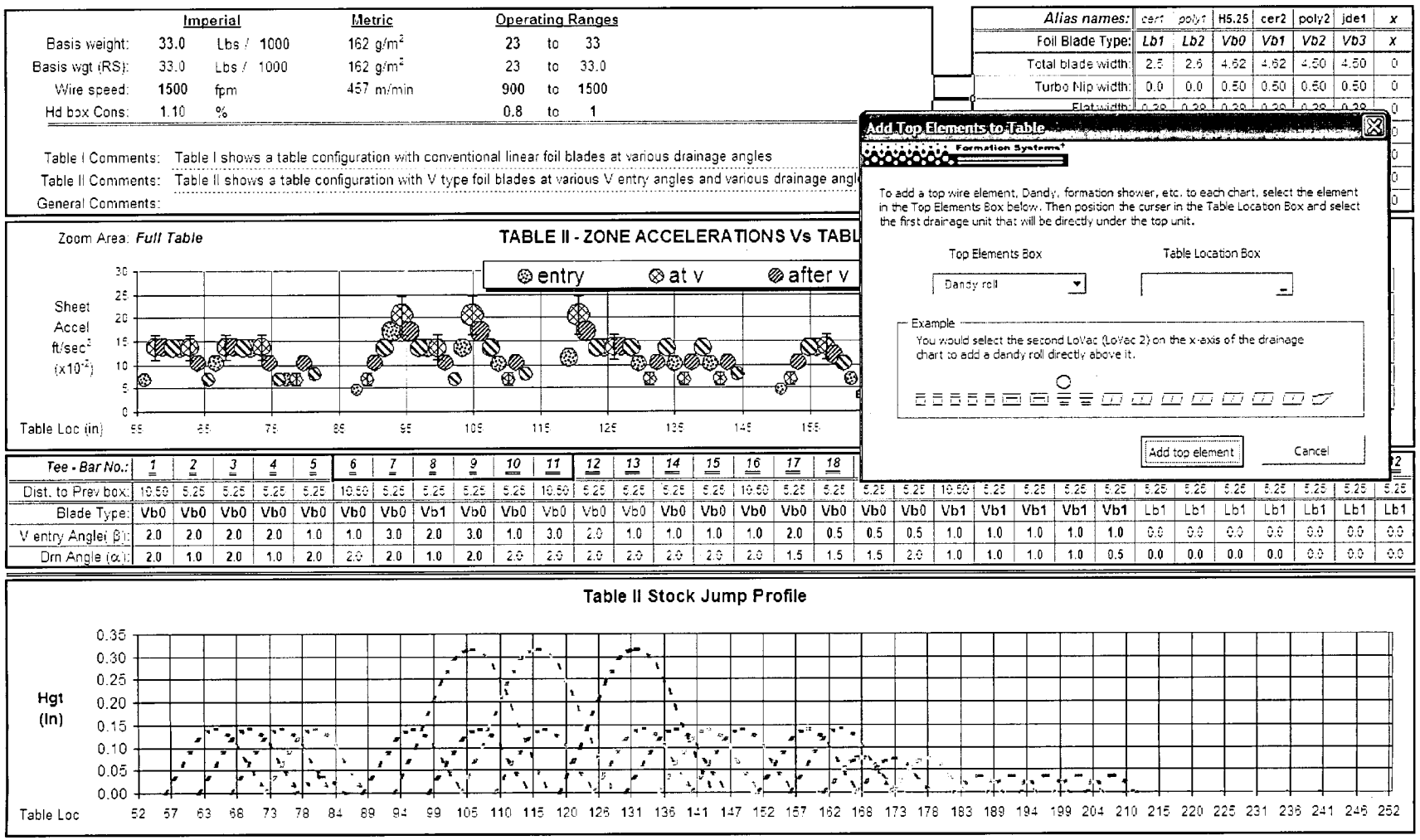

Figure 19 Drainage Model Sheet Showing Data from Gamma Gage Test for Calculating Machine Constants

| | | | | | |
|---|---|---|---|---|---|
| Customer: Any | Machine Type: **Fourdrinier** | Hb Head: **116** in | $Slice_{Hbd}$: **0.35** in | Date: 6/27/02 |
| Mach No: 1 Position: Only | Reel Speed: **1150** | R/D ratio: 0.99 | Frm Brd Loc: 8 | By: John Eames |
| Basis Wgt: 33 Lb / 1000 SqFt %Coating: **0.0** % | Pond Width: **300** in | L/b ratio: 1.0 | | |

| | | | | | | | |
|---|---|---|---|---|---|---|---|
| Wire Speed : 1500 fpm | **Forming Table I** | ADFA DRAINAGE MODEL 1: Qi=wirespd*Df^a/(kv1*Mat) | | | | **Forming Table II** | |
| Hd Box FlowO (Calc) : **45** gpm/in (Inst) : **77** gpm/in | Hd Box ConsO : **1.10** % | $Slice_{Vert}O$ **0.35** in | $Cons_{WW}$ : **0.10** % | "Total" Bld DrnO: **20.0** gpm/in | | Sheet $Cons_{LV}O$ : **2.2** % | |
| Hd Box FlowM (Calc) : **45** gpm/in (Inst) : **77** gpm/in | Hd Box ConsM : **1.10** % | $Slice_{Vert}M$ **0.35** in | $Cons_{WW}$ : **0.10** % | "Total" Bld DrnM: **20.0** gpm/in | | Sheet $Cons_{LV}M$ : **2.2** % | |
| Set Target > DrnTotal (Cal): 20.4 | By Changing Variables: | a : 1.0 | z : 97.7 | $K_{v1}$ : 55555 | Model Constraints: | a < = **1.0** | 1st Blade Drn(Calc) 0.2 | Lst Bld Drn(Calc) 0.0 | Cons leavingO(Cal): 1.9 |
| = to the Goal > DrnTotal (Act): 68.5 | | b : 1.0 | w : | $K_{v2}$ : -232.3 | | a > = **0.8** | 1st Blade Drn(Act) 2.7 | Lst Bld Drn(Act) | Cons leavingO(Act): 2.2 |

| Drainage Box | *Forming Brd* | | *Foil Box 1* | *Foil Box 2* | *Foil Box 3* | *Foil Box 4* | *Foil Box 5* | *Foil Box 6* | *Foil Box 7* | *Foil Box 8* | Totals for Table |
|---|---|---|---|---|---|---|---|---|---|---|---|
| No. Tee bars @ CL | | at | 5 at 5.25 | 5 at 5.25 | 5 at 5.25 | 5 at 5.25 | 5 at 5.25 | at | at | at | Σ Blades installed: 25 |
| No. Blades Instal'd | | | 5 | 5 | 5 | 5 | 5 | | | | |
| Blade Angles | | | 2 2 2 2 2 | 2 2 2 2 2 | 2 2 2 2 2 | 2 2 2 2 2 | 2 2 2 2 2 | | | | |
| Consistency ww | | | 0.02 | 0.02 | 0.02 | 0.02 | 0.02 | | | | |
| Activity at Box | | | 0 | 0 | 3 | 3 | 3 | | | | |
| Box Drainage(Act) | 13 | Actual | 13.5 | 12.2 | 11.0 | 9.9 | 8.9 | | | | Σ Drainage (Act): 69 |
| Box Drainage(Cal) | 12 | Calc | 12.0 | 11.0 | 12.0 | 8.0 | 7.0 | | | | Σ Drainage (Cal): 62 |
| Drn per Blade (Act) | | | 2.7 | 2.4 | 2.2 | 2.0 | 1.8 | | | | |

ADFA
Report Views | Top Units | Accel Data | Save As... | Exit

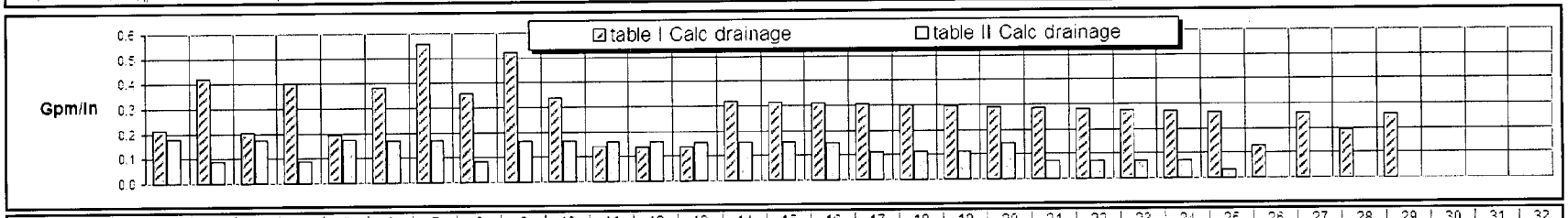

| Tee bar No: | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 | 31 | 32 |
|---|---|---|---|---|---|---|---|---|---|---|---|---|---|---|---|---|---|---|---|---|---|---|---|---|---|---|---|---|---|---|---|---|
| ADFA DRAINAGE MODEL 1: Qi=wirespd*Df^a/(kv1*Mat) **Table I - Configuration** | | | | | | | | | | | | | | | | | | | | | | | | | | | | | | | | |
| Blade (st Tb Tv) | Lb1 | Lb1 | Lb1 | Lb1 | Lb1 | Lb1 | Lb1 | Lb1 | Lb1 | Lb1 | Vb0 | Vb0 | Vb0 | Lb1 | Lb1 | Lb1 | Lb1 | Lb1 | Lb1 | Lb1 | Lb1 | Lb1 | Lb1 | Lb1 | Lb1 | Lb1 | Lb1 | Lb1 | Lb1 | Lb1 | Lb1 | Lb1 |
| Tv-angle β | 0.0 | 0.0 | 0.0 | 0.0 | 0.0 | 0.0 | 0.0 | 0.0 | 0.0 | 0.0 | 0.0 | 2.0 | 2.0 | 0.0 | 0.0 | 0.0 | 0.0 | 0.0 | 0.0 | 0.0 | 0.0 | 0.0 | 0.0 | 0.0 | 0.0 | 0.0 | 0.0 | 0.0 | 0.0 | 0.0 | 0.0 | 0.0 |
| Drn angle α | 1.0 | 2.0 | 1.0 | 2.0 | 1.0 | 2.0 | 3.0 | 2.0 | 3.0 | 2.0 | 2.0 | 2.0 | 2.0 | 2.0 | 2.0 | 2.0 | 2.0 | 2.0 | 2.0 | 2.0 | 2.0 | 2.0 | 2.0 | 2.0 | 2.0 | 1.0 | 2.0 | 1.5 | 2.0 | 0.0 | 0.0 | 0.0 |

Figure 20 Drainage Model Sheet and Dialog Box for Choosing a Drainage Model to use for a Specific Paper Grade
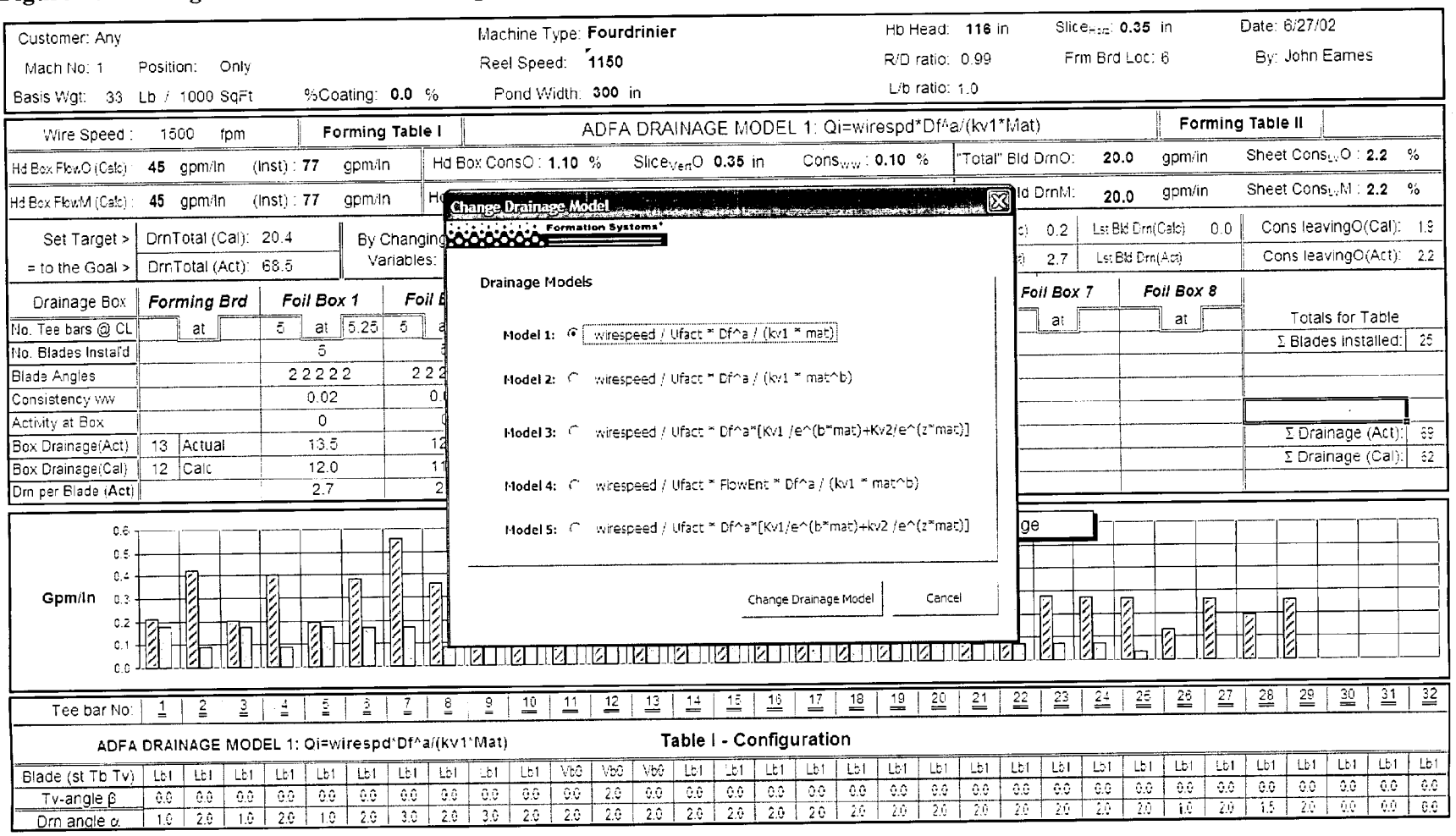

Figure 21 Drainage Model Sheet and Dialog Box for Calculating Head Box Flows
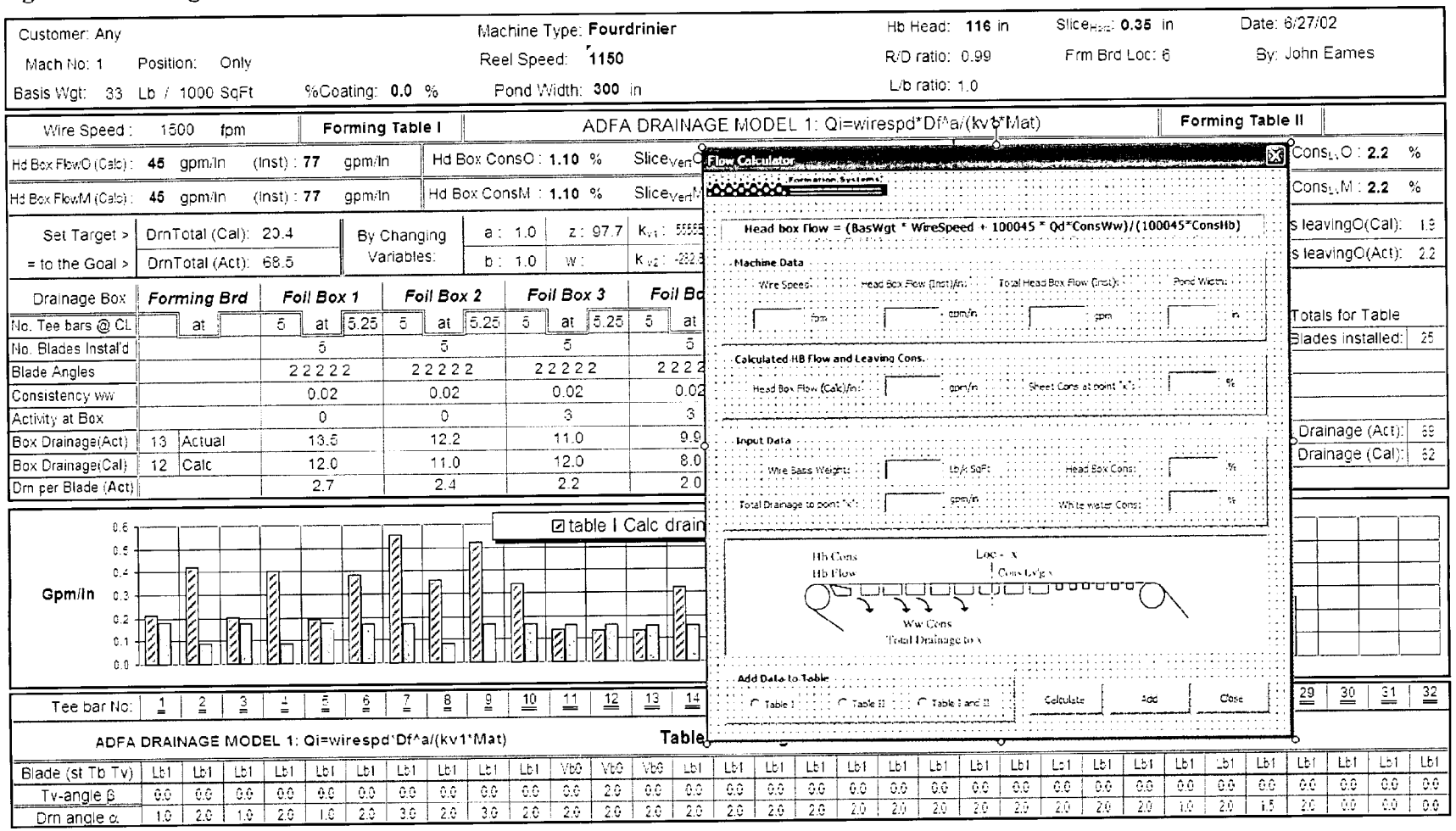

Figure 22

Model For Acceleration Forces From a Foil Blade - Ft/sec$^2$

Total acceleration=$S^2[1+L1/L2][\pi\alpha/(180\ f)]\ [\ 1 + f/d]$

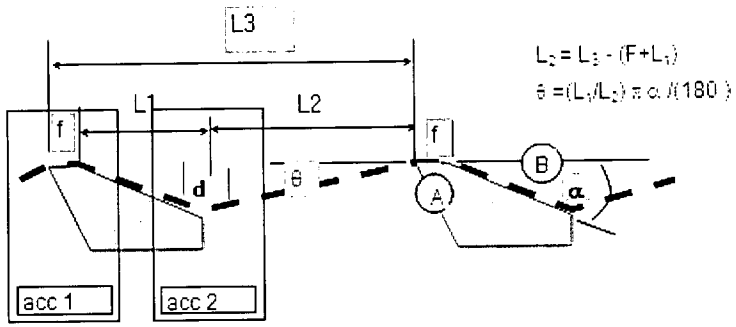

Equations: 2/28/2001

$Vz1 = S\ \sin(\theta) \sim S(L_1/L_2)\pi\ \alpha\ /(180)$ $Vz2 = S\ \sin(\alpha) \sim S\ \pi\ \alpha\ /180$ $a_1 = S\ (Vz1 + Vz2)\ /\ f \quad \sim S^2\ [\ 1 + L_1/L_2\ ]\ [\ \pi\ \alpha\ /(180\ f)\ ]$ $a_2 = S(Vz2 + Vz1)\ /\ d \quad \sim S^2\ [\ 1 + L_1/L_2\ ]\ \pi\ \alpha\ /(180\ d)$ (mine) $a_T = S^2\ [\ 1 + L_1/L_2\ ]\ [\ \pi\ \alpha\ /(180\ f)\ ][1 + f/d)\ ]$ (papers) $a_T = S^2\ [\ 1 + 2\ L_1/L_2\ ]\ [\ \pi\ \alpha\ /(180\ d_2)\ ]$ simple harmonic motion

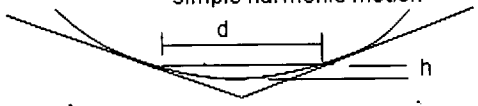

| | | |
|---|---|---|
| $a = S^2/R$ | 2789.128 ft/sec$^2$ | ( In ) |
| $h = d/4\ [\ \pi\ \alpha\ /180\ ]$ | 0.000545 ft | 0.0065 |
| $R = (4h^2+d^2)/8h$ | 0.224084 ft | 2.6890 |

SHEET ACCERATION FROM A FOIL BLADE (Ft / sec$^2$)

| Blade width (In) | | Machine | 1500 | fpm | f (Flat) | 0.25 | In | d | 0.375 | In | Note: | for SHM |
|---|---|---|---|---|---|---|---|---|---|---|---|---|
| 2 | In | Speed | 25.00 | fps | | 0.0208 | Ft | | 0.03125 | Ft | f=.375 | d=.06 |

Blade Angle α (Degrees)

| Bld Pitch | 1 | | 2 | | 3 | | 4 | | 5 | | 6 | |
|---|---|---|---|---|---|---|---|---|---|---|---|---|
| (In) | A | Total | A | Total | A | Total | A | Total | A | Total | A | Total |
| 3 | 1,440 | 2,400 | 2,880 | 4,800 | 4,320 | 7,199 | 5,760 | 9,599 | 7,199 | 11,999 | 8,639 | 14,399 |
| 5 | 829 | 1,382 | 1,658 | 2,763 | 2,487 | 4,145 | 3,316 | 5,527 | 4,145 | 6,909 | 4,974 | 8,290 |
| 6.38 | 733 | 1,221 | 1,466 | 2,443 | 2,198 | 3,664 | 2,931 | 4,885 | 3,664 | 6,107 | 4,397 | 7,328 |
| 7 | 707 | 1,178 | 1,414 | 2,356 | 2,121 | 3,534 | 2,827 | 4,712 | 3,534 | 5,890 | 4,241 | 7,069 |
| 8 | 676 | 1,127 | 1,353 | 2,254 | 2,029 | 3,382 | 2,705 | 4,509 | 3,382 | 5,636 | 4,058 | 6,763 |
| 9 | 654 | 1,091 | 1,309 | 2,182 | 1,963 | 3,272 | 2,618 | 4,363 | 3,272 | 5,454 | 3,927 | 6,545 |
| 10 | 638 | 1,064 | 1,276 | 2,127 | 1,914 | 3,191 | 2,553 | 4,254 | 3,191 | 5,318 | 3,829 | 6,381 |
| 11 | 625 | 1,042 | 1,251 | 2,085 | 1,876 | 3,127 | 2,502 | 4,169 | 3,127 | 5,212 | 3,752 | 6,254 |
| 12 | 615 | 1,025 | 1,230 | 2,051 | 1,846 | 3,076 | 2,461 | 4,102 | 3,076 | 5,127 | 3,691 | 6,152 |
| 14 | 600 | 1,000 | 1,200 | 2,000 | 1,800 | 3,000 | 2,400 | 4,000 | 3,000 | 5,000 | 3,600 | 6,000 |

| SC % | Acel |
|---|---|
| 0.4 | 2000 |
| 0.8 | 3000 |
| 1 | 4000 |

Figure 24

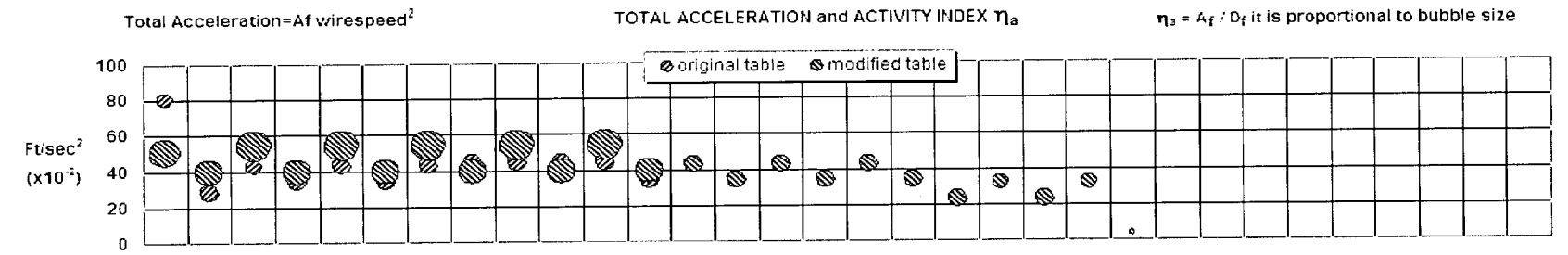

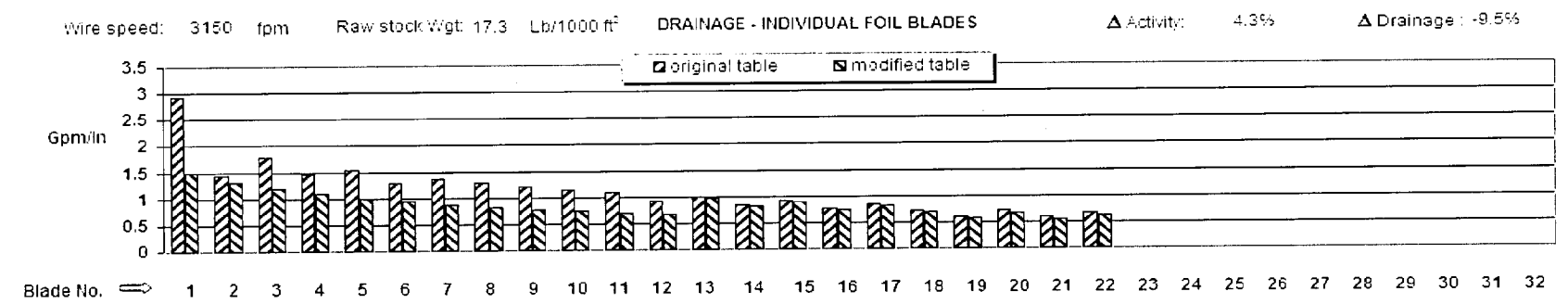

Wire speed: 3150 fpm — MODIFIED TABLE CONFIGURATION — Cons Leaving: 1.2 % — Σ Drn = 14 GPM/In

| | | | | | | | | | | | | | | | | | | | | | | | | | | | | | | | | |
|---|---|---|---|---|---|---|---|---|---|---|---|---|---|---|---|---|---|---|---|---|---|---|---|---|---|---|---|---|---|---|---|---|
| In. frm Prev Bld | 7.5 | 7.5 | 7.5 | 7.5 | 7.5 | 7.5 | 7.5 | 7.5 | 7.5 | 7.5 | 7.5 | 7.5 | 7.5 | 7.5 | 7.5 | 7.5 | 7.5 | 7.5 | 7.5 | 7.5 | 7.5 | 7.5 | 7.5 | 7.5 | 7.5 | 7.5 | 7.5 | | | | | |
| Blade width | 5.00 | 5.00 | 5.00 | 5.00 | 5.00 | 5.00 | 5.00 | 5.00 | 5.00 | 5.00 | 5.00 | 5.00 | 2.00 | 2.00 | 2.00 | 2.00 | 2.00 | 2.00 | 2.00 | 2.00 | 2.00 | 2.00 | 2.00 | 2.00 | 2.00 | 2.00 | 2.00 | 2.00 | 2.00 | 2.00 | 2.00 | 2.00 |
| Drn angle α | 0.3 | 0.3 | 0.3 | 0.3 | 0.3 | 0.3 | 0.3 | 0.3 | 0.3 | 0.3 | 0.3 | 0.3 | 1 | .75 | 1 | .75 | 1 | .75 | .5 | .75 | .5 | .75 | 0.0 | 0.0 | 0.0 | 0.0 | 0.0 | | | | | |
| Tv-angle β | 0.50 | 0.30 | 0.50 | 0.30 | 0.50 | 0.30 | 0.50 | 0.30 | 0.50 | 0.30 | 0.50 | 0.30 | 0.0 | 0.0 | 0.0 | 0 | 0 | 0 | 0 | 0 | 0 | 0 | 0 | 0 | 0 | 0 | 0 | | | | | |
| Blade (st Tb Tv) | tv | tv | tv | tv | tv | tv | tv | tv | tv | tv | tv | tv | st | st | st | st | st | st | st | st | st | st | st | st | st | st | st | st | st | st | st | st |
| Activity Index | | | | | | | | | | | | | | | | | | | | | | | | | | | | | | | | |

Wire speed: 3150 fpm — ORIGINAL TABLE CONFIGURATION — Cons Leaving: 1.4 % — Σ Drn = 15 GPM/In

| | | | | | | | | | | | | | | | | | | | | | | | | | | | | | | | | |
|---|---|---|---|---|---|---|---|---|---|---|---|---|---|---|---|---|---|---|---|---|---|---|---|---|---|---|---|---|---|---|---|---|
| In. frm Prev Bld | 7.5 | 7.5 | 7.5 | 7.5 | 7.5 | 7.5 | 7.5 | 7.5 | 7.5 | 7.5 | 7.5 | 7.5 | 7.5 | 7.5 | 7.5 | 7.5 | 7.5 | 7.5 | 7.5 | 7.5 | 7.5 | 7.5 | 7.5 | 7.5 | 7.5 | 7.5 | 7.5 | | | | | |
| Blade width | 2.00 | 2.00 | 2.00 | 2.00 | 2.00 | 2.00 | 2.00 | 2.00 | 2.00 | 2.00 | 2.00 | 2.00 | 2.00 | 2.00 | 2.00 | 2.00 | 2.00 | 2.00 | 2.00 | 2.00 | 2.00 | 2.00 | 2.00 | 2.00 | 2.00 | 2.00 | 2.00 | 2.00 | 2.00 | 2.00 | 2.00 | 2.00 |
| Drn angle α | 2 | .5 | 1 | .75 | 1 | .75 | 1 | 1 | 1 | 1 | 1 | .75 | 1 | .75 | 1 | .75 | 1 | .75 | .5 | .75 | .5 | .75 | 0.0 | 0.0 | 0.0 | 0.0 | 0.0 | | | | | |
| Tv-angle β | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | | | | | |
| Blade (st Tb Tv) | st | st | st | st | st | st | st | st | st | st | st | st | st | st | st | st | st | st | st | st | st | st | st | st | st | st | st | st | st | st | st | st |

SYSTEM AND METHOD FOR ANALYZING CONTROLLING FORMING SECTIONS OF A PAPER MACHINE IN OPERATION

CROSS-REFERENCE TO RELATED APPLICATIONS

This non-provisional utility patent application claims the benefit of one or more prior filed non-provisional applications; the present application is a Continuation-in-part of U.S. application Ser. No. 10/027,527 filed Dec. 26, 2001 now abandoned, which is incorporated herein by reference in its entirety.

BACKGROUND OF THE INVENTION (1) Field of the Invention

The present invention relates generally to paper machine operation and, more particularly, to systems and methods of analyzing and controlling paper machine operation in the formation section of a paper machine.

(2) Description of the Prior Art

Definitions

It is relevant and instructive to define those areas of a foil blade as done by the applicant for the purposes of describing the prior art and the present invention; these terms are as follows:

Activity zone or acceleration zone is the location on the blade where a change in direction is forced upon the fabric/sheet over an acceleration distance;

Approach angle is the angle at which the fabric/sheet enter the foil blade and/or acceleration zone moving in the machine direction;

Exit angle is the angle at which the fabric/sheet exit the foil blade and/or acceleration zone moving in the machine direction.

Drainage angle is the divergent angle that follows the flat surface that contacts the fabric/sheet; on a V blade it is the last divergent angle that follows the last flat surface. Drainage nip length is the sustended length of the drainage angle.

For example, in FIG. 1B of the prior art, activity zone 1 of foil blade B has an approach angle ($\theta_1$), an exit angle ($\alpha_2$), and an acceleration distance (F); also, foil blade B has a drainage angle ($\alpha_2$), and a drainage nip length (L).

Typically, foil blades are known to be used in the formation sections of paper machines and, in particular, are commonly employed on the wet end of Fourdrinier paper machines to extract water from the pulp fiber and water mixture or slurry and to induce activity of the sheet during its formation. The controlled extraction of water and the manipulation of activity levels of the sheet by using foil blades in the forming section of the paper machine are the preferred methods for controlling fiber distribution within the sheet. Additionally, manipulation of activity in the sheet can impact the quality of the finished paper sheet, most importantly in terms of its uniformity or formation.

Prior art foil blades commonly include a blade surface for contacting the sheet in the forming section of the paper machine; generally, the prior art blades are constructed so as to have a leading flat surface for contacting the sheet and the conveying fabric across the divergent surface so provided. This movement of the pulp sheet and the conveying fabric across at least one divergent surface introduced by the leading flat surface of the foil blade produces a vacuum effect on the sheet; it is this vacuum effect and the surface disruption created by the foil blade leading flat edge that are commonly recognized in the prior art to control the extraction of water and the sheet activity levels, thereby impacting the final paper sheet uniformity.

By way of further background of the prior art generally, the following brief description of the operational principles and features of conventional foil blades follows. FIG. 1A shows an arrangement of three conventional or prior art foil blade designs as they function on a paper machine interactively with the conveying fabric and sheet. The fabric travel direction is shown, also known as the machine direction. In each case, it is important to note that the foil blade has a flat leading edge that forms an angle greater than 90° with the paper sheet and conveying forming fabric as they move in the machine direction. Formerly prior art has not effected the use of the concept of "activity zones"; however, for the comparison with the present invention, the concept and related terminology set forth hereinabove is employed. The activity zones are identified with the dotted circles, Activity zone 1 and 2, respectively, on foil blade B; these activity zones are affected by the flat leading edge F and the entry and exit angles of the sheet and conveying fabric with respect to the horizontal, $\alpha_2$, $\theta_1$ and $\theta_2$, respectively, as shown in FIG. 1B, which is a close-up view of the foil blade B of FIG. 1A.

Importantly, the flat of the foil blade supports the conveying fabric and creates a water seal that enables vacuum to be generated and sustained by the motion of the conveying fabric and slurry over the divergent surface of the foil blade; thus, the leading flat edge of prior art foil blades is a critical feature to their function and operation. The water extracted from the sheet by the foil blade B is subsequently removed by a doctoring action of the foil blade C that immediately follows foil blade B in the machine direction.

Referring to FIG. 1B, discussing the general principles of operation of foil blades in the art using formulas and acceleration terminology developed and discovered by the applicant that are not taught in the prior art, foil blade B has a flat length (F), a divergent surface having an angle ($\alpha_2$) and such angle having a sustended length (L). The drainage from foil blade B is substantially proportional to the divergent angle ($\alpha_2$) and the sustended length of that angle (L). The activity imparted to the sheet by foil blade B is proportional to the acceleration of the fabric/sheet as it deflects and conforms to the surface of the foil blade. For example, referring again to FIG. 1B, the fabric/sheet approaches foil blade B at an approach angle ($\theta_1$), traverses the flat of foil blade B and diverges down the divergent surface at an angle ($\alpha_2$). The fabric leaves foil blade B and approaches foil blade C at angle ($\theta_2$). The conveying fabric/sheet experience an acceleration at two zones of activity as they traverse the foil blade B. The conveying fabric sheet enters the first activity zone at an approach angle ($\theta_1$), changes direction, and leaves the first activity zone at an exit angle ($\alpha_2$). This change in fabric direction takes place over a distance that is established by the length of the flat (F). Thus, the acceleration imparted to the sheet at activity zone 1 can be described by the following equation:

$$\text{Acceleration at zone } \mathbf{1} = (\text{fabric speed})^2 \times (\theta_1 + \alpha_2)/F$$

Similarly, the conveying fabric/sheet enters a second activity zone at an approach angle ($\alpha_2$) and leaves the second activity zone at an exit angle ($\theta_2$). Thus, the acceleration imparted to the sheet at activity zone 1 can be described by the following equation:

$$\text{Acceleration at zone } \mathbf{2} = (\text{fabric speed})^2 \times (\alpha_1 + \theta_2)/d$$

where d is the distance over which the change in direction of the fabric/sheet takes place; this distance d is on the order of about ⅛ to about ½ inch.

It is the acceleration of the sheet at activity zones 1 and 2 of the foil blade B that determines the activity imparted to the sheet as it traverses foil blade B. FIG. 1B of the prior art shows activity zone 1 of foil blade B having an approach angle ($\theta_1$), an exit angle ($\alpha_2$), and an acceleration distance (F); also, foil blade B has a drainage angle ($\alpha_2$), and a drainage nip length (L). The drainage of the foil blade B is proportional to $\alpha_2$ and L. Conventional foil blade shapes such as those illustrated in FIGS. 1A and 1B have inherent drawbacks. For example, as shown in FIG. 1B, the exit angle of activity zone and the entry angle of activity zone 2 is the angle ($\alpha_2$), which is also the drainage angle of the foil blade. Thus, the primary foil blade angle that characterizes the activity of the foil blade is the same angle that characterizes the drainage of the foil blade; this linkage between activity imparted to a sheet and the drainage for a given foil blade is undesirable because it is not possible to affect changes to sheet activity and the drainage separately by modifying the foil blade. Often it is desirable to impart a substantial activity to the sheet without a corresponding increase in sheet drainage.

Additional relevant art includes methods for configuring forming sections on paper machines, more particularly, the activity of the paper sheet is assessed visually by a technician or service engineer, who may use a strobe light or the naked human eye. Various foil blades are installed and changes are made on a trial-and-error basis; if the sheet formation is improved, then additional changes consistent with the initial change may be made or if sheet formation is not improved, then other changes may be made. Notably, qualitative analysis focused on the overall foil box, not more detail. Because of the more linear nature of the forming section and related system, changes made at an upstream location on the paper machine in the forming section have a global effect at all locations downstream on the paper machine, which is why the trial-and-error modifications approach of the prior art is ineffective and often fails.

Thus, it is desirable to have the ability to analyze and control various parameters of a paper machine in its operation, in particular in the forming section of the paper machine, including but not limited to characteristics relating to foil blades wherein the activity and drainage characteristics associated with the blades, along with other parameters like sheet activity, sheet and fabric acceleration, sheet and fabric deflection, moisture profiles, and drainage, can be substantially separately and independently analyzed, established, and controlled.

Thus, there remains a need for a system and method to quantitatively analyze and control various parameters of a paper machine in its operation, in particular in the forming section of the paper machine, including but not limited to characteristics relating to foil blades wherein the activity and drainage characteristics associated with the blades, along with other parameters like sheet activity, sheet and fabric acceleration, sheet and fabric deflection, moisture profiles, and drainage, can be substantially separately and independently analyzed, established, and controlled on an individual foil blade basis.

SUMMARY OF THE INVENTION

The present invention is directed to a system and method for analyzing and controlling various parameters of a paper machine in its operation, in particular in the forming section of the paper machine, including but not limited to characteristics relating to foil blades wherein the activity and drainage characteristics associated with the blades, along with other parameters like sheet activity, moisture profiles, and drainage, can be substantially separately and independently analyzed, established, and controlled.

In a preferred embodiment of the invention, traditional methods and devices are used for obtaining measurements and identifying the paper machine operating parameters, in particular but not limited to foil blade characteristics, activity and drainage characteristics associated with the blades, along with other parameters like sheet activity, sheet and fabric acceleration, moisture profiles, and drainage, the results from which are provided as inputs to a computer having a processor and running software for simulating paper machine parameters, settings, and configurations; this software calculates acceleration at each zone within each foil blade and drainage at each foil blade and provides a diagrammatic representation of these parameters, settings, and configurations and creates comparative charts and/or graphs thereof for comparing actual measurements or levels to optimal configurations, settings, and parameters for a particular paper machine and section. More particularly, foil blade characteristics are modified or are modifiable, either by reverse calculation or by selection of predetermined designs and their respective characteristics, to illustrate, preferably with a diagrammatic representation, the impact the various foil blade(s) and respective characteristics on sheet activity, sheet acceleration, drainage, etc., in a precise and controlled manner, based upon the foil blade design, in particular the angle that each forms with respect to the horizontal, the V width for a V-balde, flat width, and other parameters on the foil such as the width of the divergent angle, and the similar factors.

Advantageously, the desired drainage and activity characteristics in the sheet can be calculated and the foil blades of the present invention can then be designed or selected and later installed on the paper machine to produce those desired and illustrated characteristics as represented by the software, by varying the foil blade parameters, and with the introduction of additional activity-producing zones within the foil blade(s) between the leading and trailing edges.

Thus, the present invention provides for a system and method for analyzing and controlling various parameters of a paper machine in its operation, in particular in the forming section of the paper machine, including but not limited to characteristics relating to foil blades wherein the activity and drainage characteristics associated with the blades, along with other parameters like sheet activity, sheet and fabric acceleration, sheet and fabric deflection, moisture profiles, and drainage, can be substantially separately and independently analyzed, established, and controlled, as well as represented in a diagrammatic manner on a computer screen and printouts or any computer readable medium.

Accordingly, one aspect of the present invention is to provide system and method for analyzing and controlling various parameters of a paper machine in its operation, in particular in the forming section of the paper machine, including but not limited to characteristics relating to foil blades wherein the activity and drainage characteristics associated with the blades, along with other parameters like sheet activity, sheet and fabric acceleration, sheet and fabric deflection, moisture profiles, and drainage, can be substantially separately and independently analyzed, established, and controlled.

Another aspect of the present invention is to provide a system and method for analyzing and controlling various parameters of a paper machine in its operation, in particular in the forming section of the paper machine, including but not limited to characteristics relating to foil blades wherein the activity and drainage characteristics associated with the blades, along with other parameters like sheet activity, sheet and fabric acceleration, moisture profiles, and drainage, can be substantially separately and independently analyzed, established, and controlled, and for representing these parameters, settings, characteristics or configurations of the paper machine operation and the sheet being produced thereon in a diagrammatic manner on a computer screen and printouts or any computer readable medium.

Still another aspect of the present invention is to provide a system for analyzing and controlling paper machine parameters including a computer having a processor, a memory, a display, and input/output devices; at least one measurement providing measurement information about paper machine parameters, for being input into the computer; information and algorithms for calculating paper sheet characteristics for individual foil blades and individual zones of acceleration within individual foil blades for the paper machine; and a software program running on the computer for converting the measurement information and paper sheet characteristics into diagrammatic representations and comparative charts and tables that are viewable on the computer display, wherein the information contained within the diagrammatic representations and comparative charts and tables is selectively modifiable by a user, thereby providing the user with means for determining the optimum settings, configuration and parameters for the paper machine.

These and other aspects of the present invention will become apparent to those skilled in the art after a reading of the following description of the preferred embodiment when considered with the drawings.

BRIEF DESCRIPTION OF THE DRAWINGS

FIG. 8 illustrates a start-up page for the program displayed on a computer screen showing a forming section on a paper machine with activity level, drainage, and other paper machine parameters.

FIG. 9 illustrates a computer screen display and user interface showing a sheet activity drainage factor analysis according to one embodiment of the present invention.

FIG. 10 illustrates a display and user interface according to the present invention, wherein a drop down box is illustrated for permitting the user to change the V angle or drainage angle for a given foil blade.

FIG. 11 illustrates a display and user interface according to the present invention showing zone accelerations and the forming fabric deflected path for one table configuration.

FIG. 12 illustrates a display and user interface according to the present invention showing a drainage model and dialog box for a user to enter forming board data.

FIG. 13 illustrates a display and user interface according to the present invention showing a drainage model and dialog box for a user to design foil blades and enter related information.

FIG. 14 illustrates a display and user interface according to the present invention showing two table configurations and a dialog box for entering foil blade data and/or information.

FIG. 15 illustrates a display and user interface according to the present invention showing two table configurations and a dialog box for a user to design foil blades for providing a harmonic path across the blades.

FIG. 16 illustrates a display and user interface according to the present invention showing zone accelerations for two table configuration and a dialog box for a user to zoom in to view the zones at specific tee bars.

FIG. 17 illustrates a display and user interface according to the present invention showing the fabric deflected path for two tables and a dialog box for a user to zoom in to view the path at specific tee bars.

FIG. 18 illustrates a display and user interface according to the present invention showing acceleration zones, stock jump profile, and a dialog box to add a top former, along with a tool bar for accessing the various features of the program.

FIG. 19 illustrates a display and user interface according to the present invention showing the drainage model using data from gamma gauge testing for calculating the machine constants, which are used to project the drainage for each foil blade when a user inputs changes relating to the table configuration.

FIG. 20 illustrates a display and user interface according to the present invention showing the drainage model and a dialog box for a user to choose the drainage model for a particular machine and paper grade.

FIG. 21 illustrates a display and user interface according to the present invention showing the drainage model and a dialog box for calculating the head box flows.

FIG. 22 provides a model for acceleration forces from a foil blade according to the present invention, including calculations for acceleration based upon equations provided therein.

FIG. 24 illustrates another display showing a diagrammatic representation of acceleration and drainage factor analysis according to the present invention.

DETAILED DESCRIPTION OF THE PREFERRED EMBODIMENTS

Figure 1A:
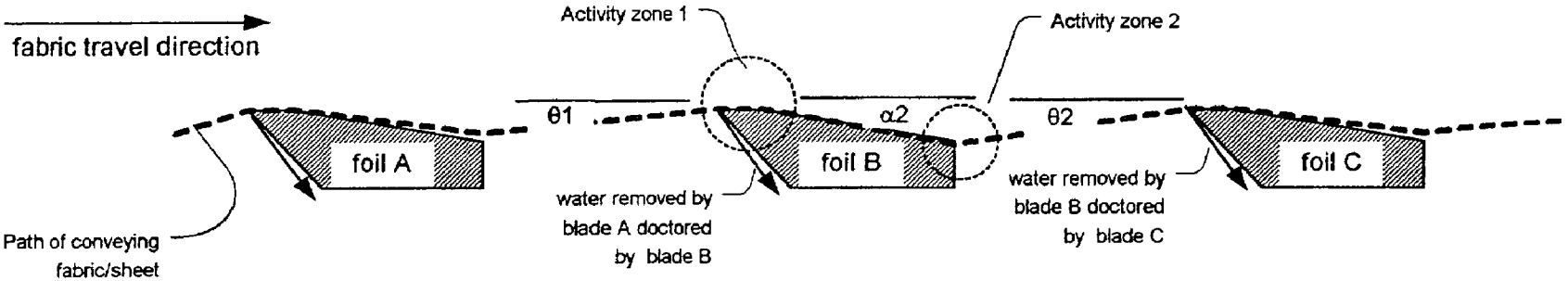
FIG. 1A is a side view of a conventional PRIOR ART foil blade.
Figure 1B:
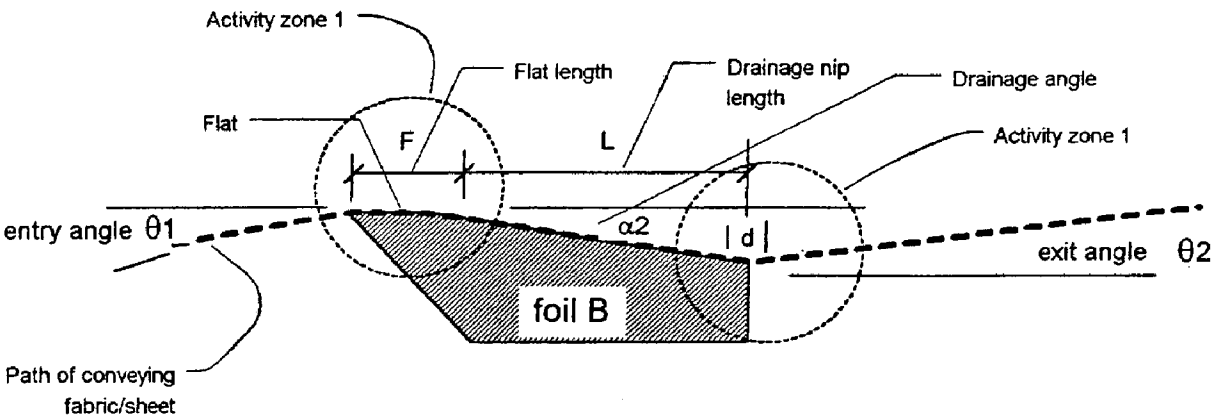
FIG. 1B is an expanded view of a section of FIG. 1A showing PRIOR ART.

In the following description, like reference characters designate like or corresponding parts throughout the several views. Also in the following description, it is to be understood that such terms as "forward," "rearward," "front," "back," "right," "left," "upwardly," "downwardly," and the like are words of convenience and are not to be construed as limiting terms. Referring now to the drawings in general, the illustrations are for the purpose of describing a preferred embodiment of the invention and are not intended to limit the invention thereto. As set forth in the summary hereinabove, one object of the present invention is to provide a system and method for analyzing and controlling various parameters of a paper machine in its operation, in particular in the forming section of the paper machine, including but not limited to characteristics relating to foil blades wherein the activity and drainage characteristics associated with the blades, along with other parameters like sheet activity, sheet and fabric acceleration, sheet and fabric defelctions, moisture profiles, and drainage, can be substantially separately and independently analyzed, established, and controlled.

The present invention provides a system and method for analyzing and controlling various parameters of a paper machine in its operation, in particular in the forming section of the paper machine, including but not limited to characteristics relating to foil blades wherein the activity and drainage characteristics associated with the blades, along with other parameters like sheet activity, sheet and fabric acceleration, moisture profiles, and drainage, can be substantially separately and independently analyzed, established, and controlled, and for representing these parameters, settings, characteristics or configurations of the paper machine operation and the sheet being produced thereon in a diagrammatic manner on a computer screen and printouts or any computer readable medium. More particularly, the present invention provides a system for analyzing and controlling paper machine parameters, the system including a computer having a processor, a memory, a display, and input/output devices; at least one measurement providing measurement information about paper machine parameters, for being input into the computer; information and algorithms for calculating paper sheet characteristics for individual foil blades and individual zones of acceleration within individual foil blades for the paper machine; and a software program running on the computer for converting the measurement information and paper sheet characteristics into diagrammatic representations and comparative charts and tables that are viewable on the computer display, wherein the information contained within the diagrammatic representations and comparative charts and tables is selectively modifiable by a user, thereby providing the user with means for determining the optimum settings, configuration and parameters for the paper machine.

Thus, the system according to the present invention includes at least one computer for running at least one software program, having a processor, a memory, input/output means, a display screen, and connectable via transmission lines or infrared/wireless transmission to various devices for obtaining measurements and data from a paper machine, either static or in operation, and for communicating with other computers or peripheral devices, including but not limited to printers and storage devices, such as various computer readable media. In particular, useful devices for obtaining measurements and for collecting data from a paper machine for providing information to input to the system according to the present invention, include but are not limited to, dimensional measurement devices, moisture scanning devices, stroboscopic devices, and the like. Information obtained by such test equipment, sensing and/or measuring devices is input either manually or automatically via electronic communication between the device(s) and the computer, when in direct connection or communicable transmission distance, according to the method of the present invention. This information input to the computer includes at least information relating to the sheet activity, sheet acceleration, drainage, and foil blade parameters and characteristics, and the relationship of blades to each other, i.e., the location or distance of foil blades with respect to each other, but may advantageously include other information relevant to the particular paper machine, paper machine clothing, and paper type being considered at the time.

The present invention provides a quantitative method and system for configuring a forming section of a paper machine. Individual blades and acceleration for individual blades are considered, specifically using information regarding their particular constructions and/or configurations on the paper machine, wherein that information is input into algorithms that calculate characteristics of the paper sheet for individual foil blades and, importantly, for individual zones of acceleration within each of the individual foil blades, thereby providing at least two orders of detail higher than any qualitative analysis that is provided by the prior art methods. Certain acceleration zones within a given foil blade have a more significant impact on the paper formation than others; without detailed analysis and consideration of each foil blade and its respective acceleration zones within any given blade, only the overall foil box impact can be identified. By contrast to the prior art, the present invention provides quantitative detailed analysis within each foil blade by inputting the characteristics of each foil blade, including its construction and configuration on the paper machine, and inputting related information into the software of the present invention for computing sheet characteristics for each of those respective zones of acceleration within each foil blade for the paper machine being considered, the computations based upon algorithms that include those characteristics within and between foil blades for the paper machine.

Deflected fabric path has never before been considered within the prior art analysis methods and/or systems for paper machine forming sections. For example, see FIG. 17, the more symmetrical the fabric path, the blade design and spacing create harmonics within the fabric so that the measured path reflects those harmonics.

Stock jump calculations have never before been considered within the prior art, in particular providing a model for the drainage of a paper sheet within the forming section of a paper machine, in particular between and for each of the individual foil blades, and, more particularly, within the acceleration zones for each foil blade. The present invention provides for reverse or back calculation of the fabric deflection at a foil blade, typically not possible to predict without the introduction of a surface discontinuity.

FIG. 8 illustrates a start-up page display and user interface for the program of the system according to the present invention as displayed on a computer screen showing a forming section on a paper machine with activity level, drainage, and other paper machine parameters.

FIG. 9 illustrates a computer screen display and user interface showing a sheet activity drainage factor analysis according to one embodiment of the present invention. The display includes an integrated view of a multiplicity of tables and/or charts and/or diagrams that relate to the paper machine forming section configurations, parameters, and/or settings, including wire speed, operating ranges, head box consistency, machine type, forming section foil blades and their characteristics and configurations, individually and/or in combination/series, paper sheet characteristics, paper machine clothing specifications and related information, for example measurements, number of fabric layers and/or construction, and other relevant information pertaining to the forming section of the paper machine and its components, in particular the foil blades. Two forming table configurations are included in the display of FIG. 9, Tables 1 and 2, labeled Table I and Table II. The first table shown includes with linear blade (LB) foil blade types, which typically have characteristics of only one angle and one flat for each blade, which is a conventional foil blade type and characteristics. The design specifications for all blades are listed in the upper right corner of the display under the foil blade type chart. Linear blade foil blade types and V-shaped blade foil blade types (VB), wherein the V blades have multiple acceleration zones within each blade. Other specifications may be used, in particular those relating to the foil blades, since the blade specifications are not necessarily fixed as the blades may be modified or substituted with different blades. This display provides an additional advantage of an advertising opportunity for foil blade manufacturers and/or suppliers to provide compensation in order for their particular blades and/or brands to be listed on the display by the software program so that the system user may identify alternatives for foil blades and evaluate the potential impact and/or effect that the alternative foil blades would likely have on the paper machine after installation, based upon the machine configuration, parameters, and settings, as well as the paper machine clothing specifications and sheet characteristics previously input by the user into the program for inclusion in the outputs illustrated by the display shown in FIG. 9 and according to the present invention.

Referring again to FIG. 9 and subsequent figures, a multiplicity of colors, shading, shape, and/or patterns are preferably used in the software program and viewable by a user of the system on the display shown in the figures for providing distinction between the entry and the exit of the foil blade, e.g., in the first table, Table I, two circular shapes having a different patter, shading, and/or color are provided to identify and distinguish the sheet characteristics at at least two different points within a given foil blade, depending upon the particular type of foil blade and its acceleration zones and other characteristics. The second table, Table II, shows VB blades having a configuration with four acceleration zones within each blade and corresponding circular shapes with a different pattern, shading and/or color that are all represented on the same diagram, i.e., the entry zone, the V zone, the post-V zone, and the exit zone of the foil blade are shown. Where the user of the system according to the present invention provides for inputs that change the parameters and/or design of the forming section, in particular changing the foil blade characteristics and/or configurations, to give different amounts or levels of sheet acceleration at each of those respective zones within each foil blade for that machine and its related parameters, settings, and/or characteristics, which constitute the information relating to the forming section and its components, such as the foil blades.

FIG. 10 illustrates a display and user interface shown on a computer screen, the display being produced by the software and inputs provided by the system user according to the present invention, wherein a drop down box is illustrated for permitting the user to change the V angle or drainage angle for a given foil blade. The corresponding circles or bubbles relating to that foil blade will then shift because the sheet acceleration that is represented thereby is automatically recalculated by the software running on the computer and is then displayed as modified or changed on the computer screen.

FIG. 11 illustrates a display and user interface according to the present invention showing a deflected fabric path at bottom part of the display page as shown on a computer screen and produced by the software running on a computer according to the present invention. FIG. 11 shows a graphical representation of the fabric path across the forming table with respect to its vertical deflection in the machine direction. Each different foil blade is represented by a different color, pattern, shape, and/or shading. Referring now to FIG. 17, a zoomed in perspective is provided by the display, which is controllable by the user via a dialog box according to the present invention, to show an enlarged portion of a deflected fabric path. The user may control the perspective via a drop down menu in an alternate embodiment of the present invention (not shown). The zoom in of the display shows the foil blades numbered 4–9 at the bottom section of the display, which are shown as being selected using highlighting in the embodiment illustrated according to the present invention.

Referring now to FIG. 12, a display and user interface produced by the software running on a computer according to the present invention illustrates a drainage model and a dialog box for a user to enter forming board data and/or information, including but not limited to changing the foil blades within the program for effecting the sheet activity and drainage as well. Test data from a gamma gauge measuring device is displayed at the top of the display page as it appears on a computer screen, which indicates the actual drainage for the paper sheet as the forming section of the paper machine is originally configured. Constants relating to fabric stiffness, furnish, etc. are calculated and used to predict the changes in drainage as the table is reconfigured according to user inputs. The present invention provides for a display of drainage differences between the original and modified configuration, settings, and conditions on a per blade basis, i.e., differences are provided and displayed for each foil blade. Also, a drop down box is shown in FIG. 12 for entering drainage data onto forming board is also provided on the display and user interface so that the user of the system according to the present invention can input drainage and related information manually. Alternatively, drainage and related information may be electronically input directly from measurement devices and/or from connection(s) to control systems on the paper machine itself.

FIG. 12 further shows a display and user interface according to the present invention providing the drainage model related to the display and user interface, including inputs by the user, wherein a gamma gauge was used to construct the existing table in that figure. The actual drainage is introduced by the user entering a measurement; calculations are performed to determine the constants that involve a multiplicity of components and factors, wherein the constants are calculated based on the actual measurements from the gamma gauge, which are for specific fabric, furnish, machine speed, and other limitations and not directly applicable on a broad or general scale.

FIG. 13 illustrates a display and user interface according to the present invention providing for a drop down and/or dialog box for the user to add new foil blade information, including specifications for the blade geometry, acceleration zones, and overall blade design types, in order to effectively custom design a foil blade for the particular machine, including factors such as width, length, surface discontinuities, etc.

FIG. 14 illustrates a display and user interface according to the present invention wherein each blade type is indicated and/or represented by a different color, pattern, shading, and/or shape and combinations thereof such that a distinct foil box having more than one blade is readily identifiable by the user of the system. A dialog box for zooming in to view specific information associated with particular, selected foil blades is also shown, wherein the user may provide inputs and/or make selections from drop down menus provided by the software according to the present invention.

FIG. 15 illustrates a display and user interface according to the present invention showing two table configurations and a dialog box for designing V type foil blades for creating a harmonic path of the sheet through that section of the paper machine. The user can provide inputs and/or make selections from drop down menus within the dialog box provided by the software according to the present invention, including factors such as blade center distance, turbo nip width, flat width, drainage nip width, V down angle width, and the like, and calculations for related and/or corresponding constants and values are provided by the software and displayed for the user.

FIG. 16 illustrates a display and user interface according to the present invention showing the zone accelerations for two table configurations and a dialog box for zooming the zones at specific tee bars. Zooming is often necessary to show the detail of particular zones because the distances between zones may be 1–2 inches but the scale of a chart may represent 300 inches. In particular, the display shows zones of tee bars 4–11 zoomed and indicated by highlighting at the bottom left portion of the display.

FIG. 17 illustrates a display and user interface according to the present invention wherein a fabric deflected path and a dialog box is provided for the user to zoom in on the path at specific tee bars. Importantly, this display according to the present invention illustrates tables and diagrammaticly represented information relating to harmonics in the forming section of the paper machine, specifically for the fabric deflection path on each table based upon its proximity to specific tee bar locations.

FIG. 18 illustrates a display and user interface according to the present invention showing accelerations zones, a stock jump profile, and a dialog box to add a top former element to the table. A toolbar for accessing various features of the program is also provided in the central upper portion of the display.

FIG. 19 illustrates a display and user interface according to the present invention providing for a comparative chart drainage model that uses data from a gamma guage test for calculating machine constants that are used to project the drainage of each foil blade as changes are made to the table configuration by the user. Comparative data is shown for both tables 1 and 2 in the central portion of the display with supporting data and information therebelow. Table 1 may preferably be the original table and its associated settings, parameters, and/or configuration or one that is designed based upon inputs provided by the user and entered into the software via the user interfaces. Importantly, individual drainages for each foil blade are viewable by the user in this display.

FIG. 20 illustrates a display and user interface according to the present invention wherein five different drainage equation models for calculating drainage on each individual blade are shown. These drainage models are provided to range from high speed newsprint machines to low speed heavyweight machines. The user is provided the capability to select various drainage model(s) and/or equation(s), wherein different constants are provided for different equations, respectively. Importantly, all charts illustrated and provided within the displays of the program according to the present invention are automatically updated if there is a change drainage model, in particular based upon the inputs and/or selections provided by the user.

FIG. 21 illustrates a display and user interface according to the present invention wherein a dialog box with head box flow calculations based upon inputs provided or entered and/or selected by the user. A diagrammatic model of the head box is also provided to illustrate the results to the user.

FIG. 22 provides a model for acceleration forces from a foil blade according to the present invention, including calculations for acceleration based upon equations provided therein. This model is incorporated into the software according to the present invention for use in the system and method thereof.

Figure 23:
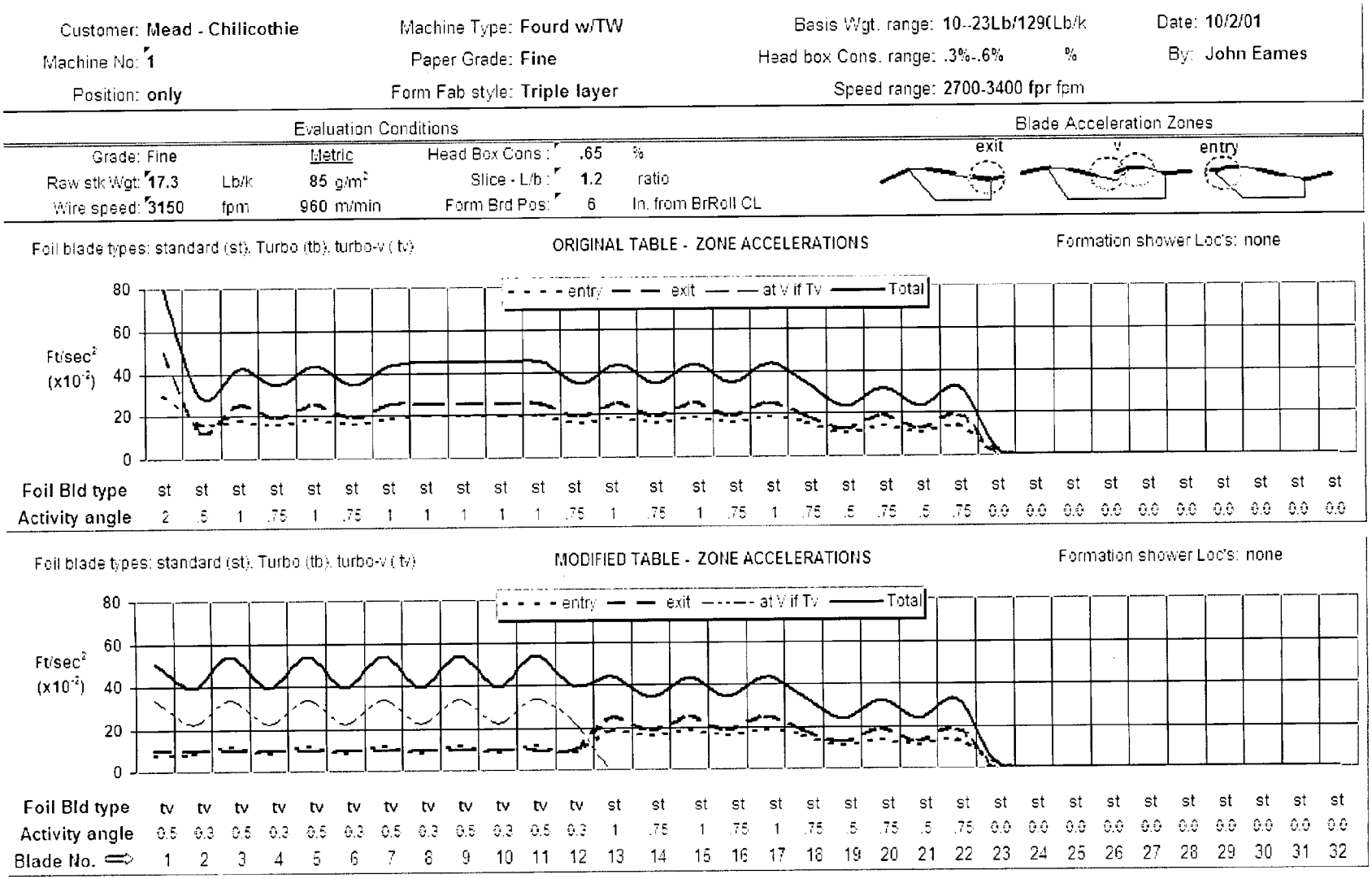
FIG. 23 illustrates a display showing a diagrammatic representation of acceleration and drainage factor analysis according to the present invention.

The present invention also provides a system and method for analyzing and controlling various parameters of a paper machine in its operation, in particular in the forming section of the paper machine, including but not limited to characteristics relating to foil blades wherein the activity and drainage characteristics associated with the blades, along with other parameters like sheet activity, sheet and fabric acceleration, moisture profiles, and drainage, can be substantially separately and independently analyzed, established, and controlled, and for representing these parameters, settings, characteristics or configurations of the paper machine operation and the sheet being produced thereon in a diagrammatic manner on a computer screen and printouts or any computer readable medium. More particularly, a diagrammatic representation of the paper machine parameters, settings, and configuration is constructed by the software running on the computer based on the inputs provided, showing, by way of example and not limitation, the sheet and fabric acceleration and activity within specific zones of the forming section of the paper machine according to predetermined formulas, as shown in FIG. 22. Additionally, the screen or display is capable of showing various diagrammatic views as shown in FIGS. 23 and 24.

One parameter, machine characteristic or configuration that may be analyzed using the system and method according to the present invention is the foil blade that can be installed on the paper machine in either of two opposite orientations with respect to the travel direction of the conveying fabric, or machine direction, for predicting, establishing, and controlling the sheet activity and drainage characteristics. Additional surface discontinuities, such as those identified and set forth in U.S. patent application Ser. No. 10/027,527, incorporated herein by reference in its entirety, may significantly impact the present invention, which is based upon inputs including foil blade parameters.

As such, the following description directed to various foil blade embodiments that may be analyzed, modified by considering alternatives, and controlled using the system and method according to the present invention are presented in context of the orientation of the foil blade relative to the travel direction of the conveying fabric and sheet, or machine direction. To this end, descriptive terms such as first, second, entry and exit are intended to be taken in context of the travel direction of the conveying fabric and sheet relative to the foil blade as indicated for each drawing or representation and descriptions thereof.

Figure 2A:
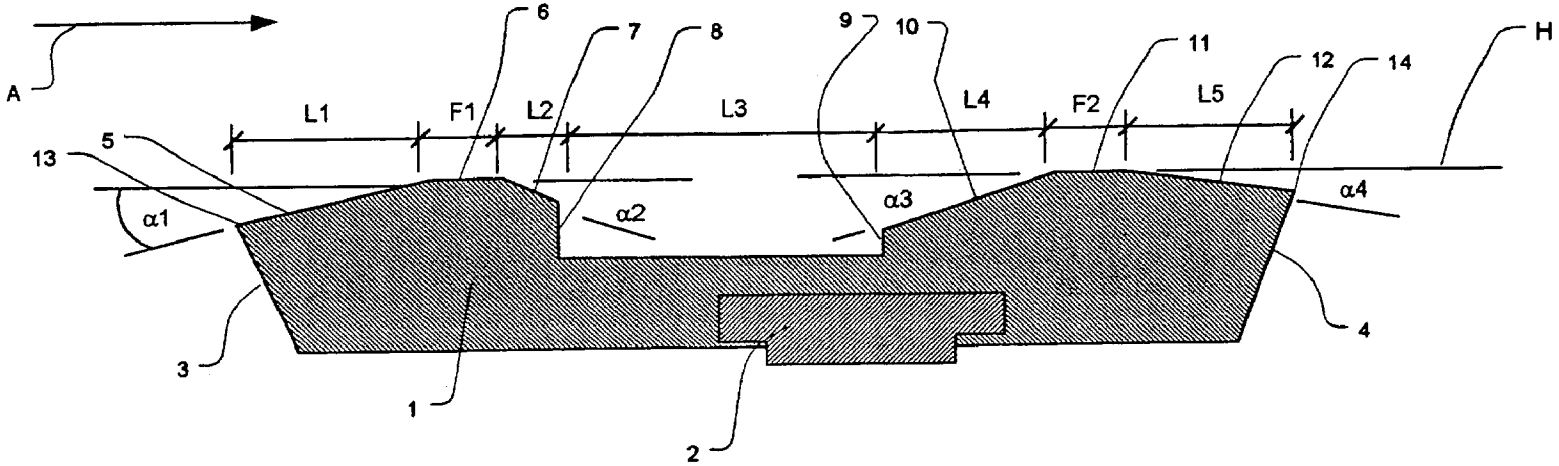
FIG. 2A is a side view of a foil blade embodiment that may be used with the present invention.
Figure 2B:
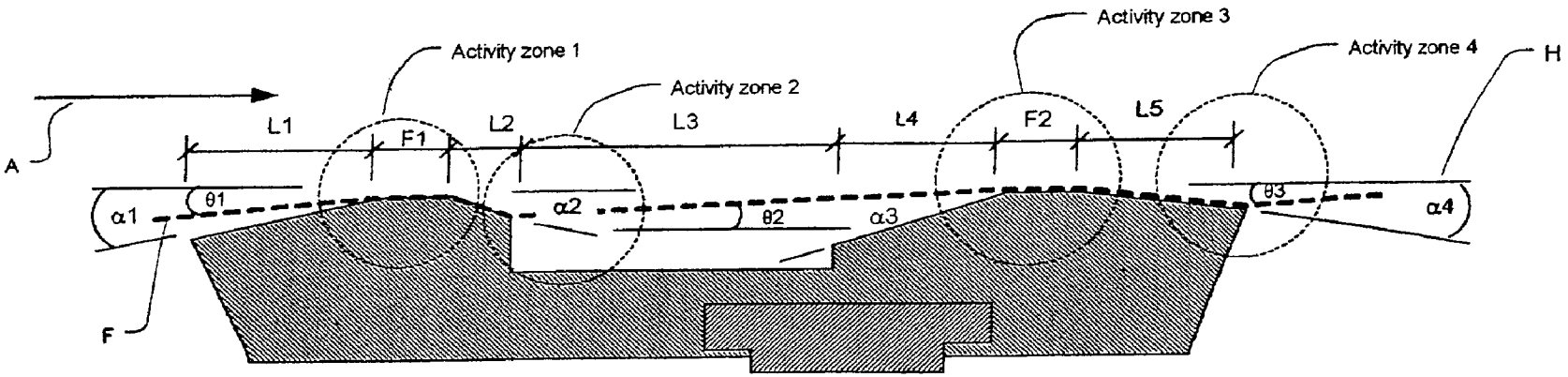
FIG. 2B is the side view of FIG. 2A with additional activity zones indicated.
Figure 2C:
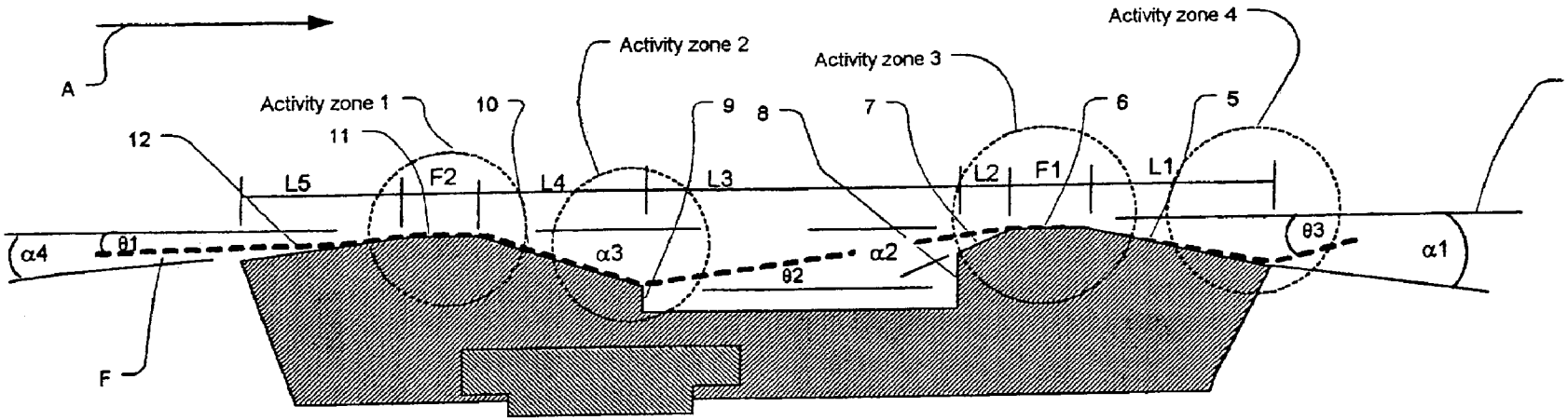
FIG. 2C is the side view of FIG. 2A with additional activity zones indicated.

As best seen in FIG. 2A, a foil blade embodiment, which may be analyzed and modified by considering alternatives and controlled using the system and method according to the present invention is shown, generally referenced 1, having an orientation relative to the travel direction of the conveying fabrics, or machine direction, as illustrated by the travel direction arrow A. FIG. 2B shows the same blade shown in FIG. 2A, and illustrating the path of the conveying fabric and sheet as they traverse the foil blade simultaneously. FIG. 2B also shows the foil blade activity zones and the foil blade drainage angle and the drainage nip length for the orientation shown in FIG. 2A. FIG. 2C shows the same blade shown in FIG. 2A, but it illustrates a reversed blade orientation with respect to the travel direction of the conveying fabric and sheet; this direction shown in FIG. 2C is opposite that direction shown in FIG. 2A and FIG. 2B. FIG. 2C also shows the path of the conveying fabric and sheet as they traverse the foil blade simultaneously in the reversed orientation; a delineation of surface elements corresponding to those shown in FIG. 2A.

Referring now to FIGS. 2A and 2B, while traditional substantially flat- or continuous-surfaced foil blades may be used on a given paper machine, where additional control and influence on sheet activity and drainage may be desired, a foil blade having surface discontinuities may be used; such a foil blade having surface discontinuities is illustrated with the foil blade (1) oriented relative to the travel direction of the conveying fabric as indicated by the direction arrow A. Such a foil blade (1) is constructed with a tee slot (2) to facilitate the mounting, installation and/or removal of the blade on the paper machine in the cross-machine direction such that the foil blade leading edge (13) is established substantially perpendicular to the conveying fabric and sheet. The tee slot (2) is constructed and configured to receive a tee bar (not shown) or other mounting means connected to the paper machine for installation of the foil blade on the machine; these mounting means are known to one of ordinary skill in the paper machine and foil blade art, and may employ mounting means such as a bar, dovetail mount, etc. The tee slot may be centered with respect to the foil blade, or it may be offset from the center such that reversal of the blade changes the amount of the blade that is positioned ahead of the tee slot. A first doctoring surface (3) is provided by the foil blade for deflecting the water that is carried on the underside of the approaching conveying fabric, which is illustrated by a dotted line in FIG. 2B, away from the conveying fabric thereby providing drainage of the fabric and the sheet. A second doctoring surface (4) is also shown; it assumes the same function as the first doctoring surface when the foil blade is oriented in a reverse direction, as shown in FIG. 2C. The second doctoring surface also serves to prevent fiber build-up at the back edge of the blade when the foil blade assumes the orientation shown in FIG. 2B; in this orientation, the second doctoring surface is presented as a trailing surface along with the trailing or exit edge (14). An entry surface (5) having an angle $\alpha_1$ and a subtended length L1, which extends to form the angle $\alpha_1$ with the horizontal line H, is established for the foil blade oriented as shown in FIG. 2B; this angle $\alpha_1$ is less than about 90 degrees with the horizontal H, preferably between about 0 to about 10 degrees and functions to moderate the quantity of water doctored off the conveying fabric by the doctoring surface (3), thereby controlling the drainage characteristics associated with that orientation of the foil blade. A first flat surface (6) having a length F1, which defines the acceleration distance of activity zone 1, as shown in FIG. 2B is positioned directly following the entry surface (5). A first divergent surface (7) having an angle $\alpha_2$ and a subtended length L2, which extends to form the angle $\alpha_2$ with the horizontal line H, is established for the foil blade oriented as shown in FIG. 2B. A surface discontinuity (8) may be located following and establishes the first divergent surface (7); the location of the surface discontinuity establishes the maximum deflection of the conveying fabric as it conforms to the divergent surface when it exits activity zone 1 and enters activity zone 2. Angle $\alpha_2$ is the exit angle of activity zone 1. The present invention does not necessarily need to employ any surface discontinuity between the foil blade leading and exit edges (13, 14 respectively for FIGS. 2A and 2B); the surface discontinuity is predetermined, selected, and employed only where additional activity of the sheet is desired.

For the first orientation shown in FIGS. 2A and 2B, the activity zone 1 or first activity zone is established and defined by the approach angle $\alpha_1$, the acceleration distance F1, and the exit angle $\alpha_2$ These parameters can be separately and independently predetermined and selected in such a configuration to achieve or produce a desired acceleration or sheet activity within the first activity zone. Furthermore, these parameters can be predetermined and selected in such a configuration without impacting drainage characteristics associated with the foil blade; rather, the foil blade drainage characteristics are predetermined, selected and established by the divergent surface (12), its drainage angle $\alpha_2$ and its sustended length L5, where L5 is the drainage nip length, as shown in FIG. 2B. Thus, the first orientation produces a first activity zone or a first acceleration zone according to the following:

$$\text{Acceleration at zone } \mathbf{1} = (\text{fabric speed})^2 \times (\theta_1 + \alpha_2)/F\mathbf{1}$$

Similarly, activity zone 2 or the second activity zone is established and defined by the approach angle $\alpha_2$, the acceleration distance d, and the exit angle $\theta_2$. The exit angle $\theta_2$ of the second activity zone is affected and is capable of being manipulated by the location of the first surface discontinuity (8), as shown in FIG. 2B, such that $\theta_2 = L2/((L3+L4)\times\alpha_2)$. Thus, the first orientation produces a second activity zone or a second acceleration zone according to the following:

$$\text{Acceleration at zone } \mathbf{2} = (\text{fabric speed})^2 \times (\theta_2 + \alpha_2)/d$$

Surprisingly, the location of the first surface discontinuity (8) has a material and important impact on the acceleration at the activity zone 2 when the foil blade is oriented as shown in FIGS. 2A and 2B, or the first orientation; however, when the foil blade is arranged in a reversed orientation as shown in FIG. 2C, the location of the surface discontinuity is inconsequential. In FIG. 2C, the conveying fabric and sheet are directed toward the flat (11). Also surprisingly, any surface discontinuity present between the leading edge (13) and the exit edge (14) of the foil blade essentially nullifies the effect of the following surfaces with respect to activity or acceleration of the sheet.

Referring once again to FIGS. 2A and 2B, this foil blade type may further include a convergent surface (10) having an angle $\alpha_3$ and a sustended length of that angle, L4. The sustended length L4 is established by the location of a second surface discontinuity (9). The convergent surface (10) and the second surface discontinuity (9) do not produce any significant effect for the first orientation shown in FIG. 2B. However, the location of the second surface discontinuity has a significant impact on the acceleration or activity at the activity zone 1 or first activity zone when the foil blade is positioned in the reverse orientation shown in FIG. 2C.

Furthermore, as shown in FIGS. 2A and 2B, such a foil blade may include a second flat (11) having a length F2; this second flat is predetermined and selected to define the acceleration distance of activity zone 3 or the third activity zone. A divergent surface (12) is predetermined, selected and configured to produce an angle $\alpha_4$ and a sustended length L5, which establish the drainage angle of the foil blade and drainage nip length of the foil blade, respectively, when the foil blade is arranged in the first orientation shown in FIGS. 2A and 2B. Thus, the drainage associated with the foil blade for the first orientation is substantially established according to the following:

$$\text{Drainage} \sim \alpha_4 \times L\mathbf{5}$$

Referring now to FIG. 2C, in an alternate paper machine configuration of the foil blade(s) to influence running characteristics and/or parameters, which may be illustrated by the system and method according to the present invention, a reverse orientation of the foil blade is shown. This reverse orientation is established by reconfiguring the foil blade, which is set forth in the foregoing description of a foil blade having surface discontinuities, on the paper machine such that it is installed or mounted in the opposite or reverse direction to that shown in the first orientation of FIGS. 2A and 2B. For this reversed orientation, the foil blade has drainage and activity characteristics that are materially different than those for the same foil blade when it is configured in the first orientation. As with the first orientation, the drainage and activity characteristics of the foil blade are predetermined, selected, and established by the components of the foil blade; for the first orientation, as shown in FIGS. 2A and 2B, these drainage and activity characteristics are set forth as follows:

$$\text{Acceleration at zone } \mathbf{1} = (\text{fabric speed})^2 \times (\theta_1 + \alpha_2)/F\mathbf{1}$$

$$\text{Acceleration at zone } \mathbf{2} = (\text{fabric speed})^2 \times (\theta_2 + \alpha_2)/d$$

$$\text{Acceleration at zone } \mathbf{3} = (\text{fabric speed})^2 \times (\theta_2 + \alpha_4)/F\mathbf{1}$$

$$\text{Acceleration at zone } \mathbf{4} = (\text{fabric speed})^2 \times (\theta_3 + \alpha_4)/d$$

$$\text{Drainage} \sim \alpha_4 \times L\mathbf{5}$$

where d is the acceleration distance or the distance over which the fabric changes direction, which is essentially constant approximately about ⅜ to about ¼ inch, and $\theta_1$ is the angle of the fabric with the horizontal H at activity zone 1, $\theta_2$ is the angle of the fabric with the horizontal H at activity zone 2, and $\theta_3$ is the angle of the fabric with the horizontal H at activity zone 4. Note that for convenience, d is approximated as being about equal to the distance of a flat, e.g., F2.

Significantly, for the reverse orientation from that shown in FIGS. 2A and 2B, which is shown in FIG. 2C, these drainage and activity characteristics are set forth as follows:

$$\text{Acceleration at zone } \mathbf{1} = (\text{fabric speed})^2 \times (\theta_1 + \alpha_3)/F\mathbf{2}$$

$$\text{Acceleration at zone } \mathbf{2} = (\text{fabric speed})^2 \times (\theta_2 + \alpha_3)/d$$

$$\text{Acceleration at zone } \mathbf{3} = (\text{fabric speed})^2 \times (\theta_2 + \alpha_1)/F\mathbf{1}$$

$$\text{Acceleration at zone } \mathbf{4} = (\text{fabric speed})^2 \times (\theta_3 + \alpha_1)/d$$

$$\text{Drainage} \sim a_1 \times L\mathbf{1}$$

where d is the acceleration distance or the distance over which the fabric changes direction, which is essentially constant approximately about ⅜ to about ¼ inch, and $\theta_1$ is the angle of the fabric with the horizontal H at activity zone 1, $\theta_2$ is the angle of the fabric with the horizontal H at activity zone 2, and $\theta_3$ is the angle of the fabric with the horizontal H at activity zone 4.

The formulas set forth hereinabove are applicable for reversible foil blade configurations of the present invention having those components shown and illustrated in FIGS. 2A, 2B and 2C. These figures are used for illustrative purposes and are not intended to be limiting as to the range of foil blade types that may be included for providing alternatives to the existing conditions, parameters, and configuration on a paper machine that is being evaluated using the system and method according to the present invention; one of ordinary skill in the art will recognize that additional foil blade types that may be considered as alternatives for optimization of the paper machine parameters, settings, and configuration using the system and method for analyzing and controlling various parameters of a paper machine in its operation according to the present invention and are properly considered within the scope of the present invention.

Figures 3, 4, 5, 6, 7:
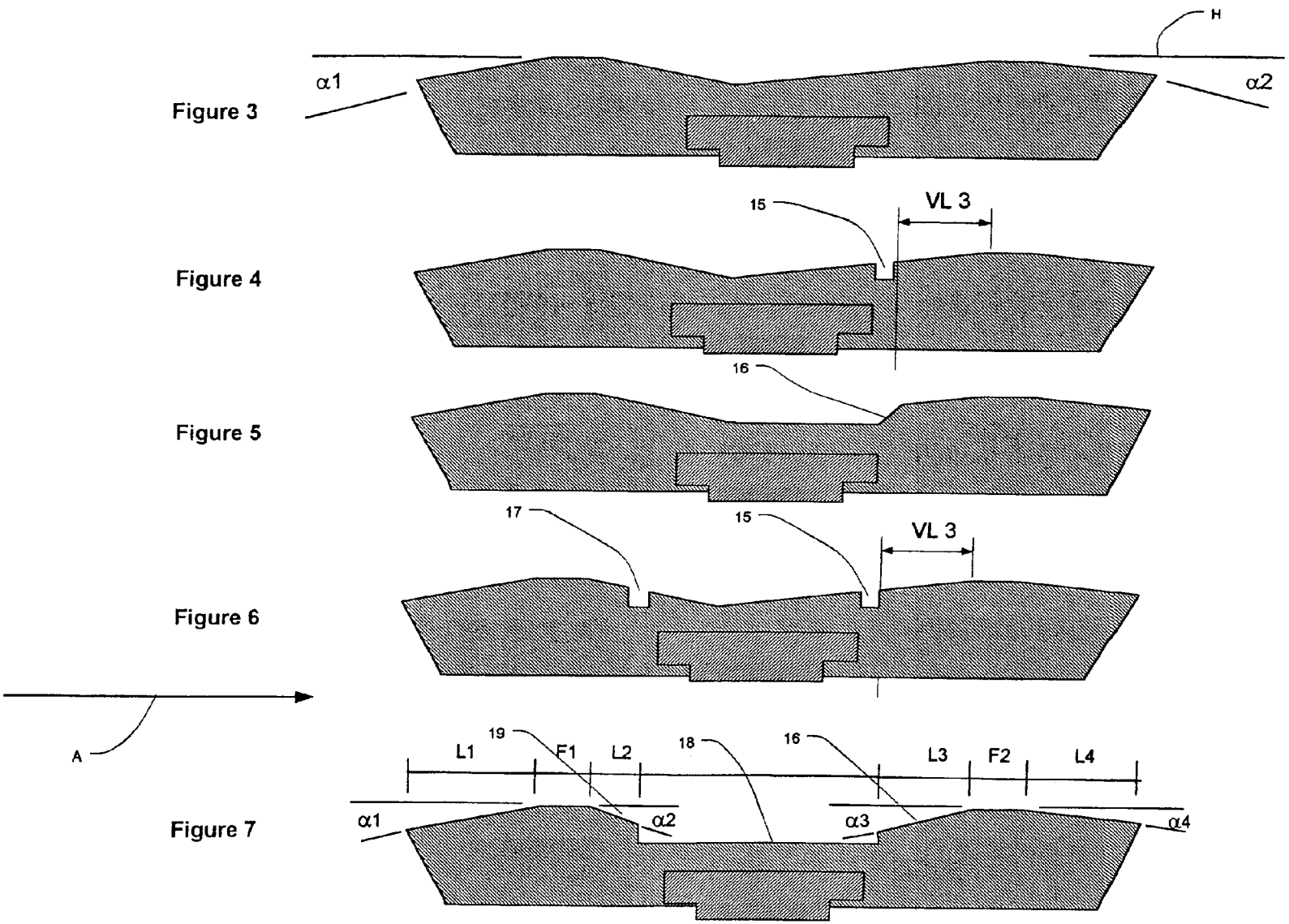
FIG. 3 illustrates a side view of one embodiment of a foil blade that may be used with the present invention.
FIG. 4 illustrates a side view of one embodiment of a foil blade that may be used with the present invention.
FIG. 5 illustrates a side view of one embodiment of a foil blade that may be used with the present invention.
FIG. 6 illustrates a side view of one embodiment of a foil blade that may be used with the present invention.
FIG. 7 illustrates a side view of one embodiment of a foil blade that may be used with the present invention.

Alternative embodiments of foil blade designs having additional angles, surfaces, and predetermined discontinuities may be similarly predetermined, calculated, and designed based on appropriate modifications to the formulas as will be obvious to those skilled in the art upon review of the foregoing description. By way of example, not limitation, FIGS. 3, 4, 5, 6, and 7 illustrate some alternative embodiments of the present invention. FIG. 3 illustrates a foil blade (1) having a leading edge angle $\alpha_1$ with the horizontal line H and an exit angle $\alpha_2$ with the horizontal line H, where angle $\alpha_1$ affects the sheet activity and angle $\alpha_1$ affects the sheet drainage for the foil blade orientation similar to FIGS. 2A and 2B, where the conveying fabric and sheet first meet the leading edge angle $\alpha_1$ as they traverse the foil blade and later pass over exit angle $\alpha_2$ in the direction of arrow A No surface discontinuity is included for the foil blade configuration shown in FIG. 3; the fabric/sheet essentially follow the surfaces without substantial deflection therefrom but deflecting from the horizontal H along with the surface. FIG. 4 shows a foil blade with the same orientation and construction as that shown in FIG. 3, and further includes a groove surface discontinuity (15) with a following surface length VL3. FIG. 4 shows the location of a groove surface discontinuity that does not have a significant impact when the fabric/sheet travel in the direction A, but do have a significant impact when the blade is positioned in a reverse orientation, since the surface discontinuity limits the fabric deflection from the horizontal as the fabric follows the divergent angle surface until it meets with the surface discontinuity, i.e., the surface discontinuity interrupts the fabric, which is otherwise following the blade surface. In this way, the introduction of a surface discontinuity provides for controlled fabric deflection, and therefore controlled sheet activity. FIG. 5 shows a foil blade with the same orientation and construction as that shown in FIG. 3, and further includes a recessed surface discontinuity (16). FIG. 6 shows a foil blade with the same orientation and construction as that shown in FIG. 3, and further includes a first groove surface discontinuity (17) and a second groove surface discontinuity (15) with a following surface length VL3. FIG. 7 shows a foil blade with the same orientation and construction as that shown in FIG. 3, and further includes a first recessed surface discontinuity (19) and a second recessed surface discontinuity (16) with a convex surface therebetween (18), wherein the first and second recessed surface discontinuities form the entry and exit angles, $\alpha_1$ and $\alpha_2$, respectively, with the horizontal H, which is the configuration set forth in the foregoing detailed description of the FIGS. 2A, 2B, and 2C. The convex surface discontinuity (18) provides a truncated first and second recessed surfaces (19) and (16), respectively, which creates another surface discontinuity itself. It is important to note that the reversible function of the foil blade is effective for each of these illustrations used as examples in the foregoing.

Certain modifications and improvements will occur to those skilled in the art upon a reading of the foregoing description. By way of example, where dialog boxes are provided for input and/or selections to be made by the user, drop down menus may be used in addition thereto, combination therewith, or alternatively thereto. All modifications and improvements have been deleted herein for the sake of conciseness and readability but are properly within the scope of the following claims.

I claim:

1. A system for analyzing and controlling paper machine parameters comprising a computer having a processor, a memory, a display, and input/output devices;

at least one measurement providing measurement information about paper machine parameters, for being input into the computer;

information and algorithms for calculating paper sheet characteristics for individual foil blades and individual zones of acceleration within individual foil blades for the paper machine and a software program running on the computer for converting the measurement information and paper sheet characteristics into diagrammatic representations and comparative charts and tables that are viewable on the computer display, wherein the information contained within the diagrammatic representations and comparative charts and tables is selectively modifiable by a user, thereby providing the user with means for determining optimum settings, configuration and parameters for the paper machine.

2. The system according to claim 1, wherein the information includes sheet activity data and drainage associated with at least one foil blade within a forming section of the paper machine.

3. The system according to claim 2, further including information relating to at least one foil blade having at least one surface discontinuity following an entry surface of the foil blade, wherein the at least one surface discontinuity predetermines the maximum fabric and sheet deflection for the foil blade.

4. The system according to claim 1, wherein the information includes characteristics of the at least one foil blade and the effect of the at least one foil blade on drainage and sheet activity.

5. The system according to claim 1, wherein the charts and tables include formulas for calculating modifications to the measured settings, configurations, and parameters of the paper machine.

6. A method for analyzing and controlling paper machine parameters comprising the steps of:

using at least one measurement to obtain information on paper machine parameters, at least one measurement device being capable of communicating information to a computer;

using the computer having a processor, a memory, a display, and input/output devices, wherein the computer is running a software program for converting the information into diagrammatic representations and comparative charts and tables that are viewable on the computer display, wherein the information contained within the diagrammatic representations and comparative charts and tables is selectively modifiable by a user, thereby providing the user with means for determining optimum settings, configuration and parameters for the paper machine, including foil blades in the forming section;

using information and algorithms for calculating paper sheet characteristics for individual foil blades and individual zones of acceleration within individual foil blades for the paper machine;

modifying the information input into the computer by a user to generate modified settings, configurations, and parameters;

automatically generating diagrammatic representations and comparative charts and tables that are viewable on the computer display, thereby identifying settings, configurations, and parameters that may be modified and controlled on the paper machine to affect sheet properties.

7. The method according to claim 6, wherein the at least one measurement is taken using a measurement device.

8. The method according to claim 6, wherein the information is automatically communicated electronically into the computer for the at least one parameter.

9. The method according to claim 6, wherein the information includes sheet activity data and drainage associated with at least one foil blade within a forming section of the paper machine.

10. The method according to claim 9, further including information relating to at least one foil blade having at least one surface discontinuity following an entry surface of the foil blade, wherein the at least one surface discontinuity predetermines the maximum fabric and sheet deflection for the foil blade.

11. The method according to claim 6, wherein the information includes characteristics of the at least one foil blade and the effect of the at least one foil blade on drainage and sheet activity.

* * * * *